US005622142A

United States Patent [19]

Strieber et al.

[11] Patent Number: 5,622,142

[45] Date of Patent: Apr. 22, 1997

[54] ROTATING PISTON ENGINE WITH VARIABLE EFFECTIVE COMPRESSION STROKE

[76] Inventors: Louis C. Strieber, 6800 West Gate Blvd. #139B316, Austin, Tex. 78745; Edward M. Strieber, Jr., P.O. Box 203312, Austin, Tex. 78720-3312

[21] Appl. No.: 512,670

[22] Filed: Aug. 8, 1995

[51] Int. Cl.[6] ..... F02B 75/26

[52] U.S. Cl. ..... 123/45 A; 123/316

[58] Field of Search ..... 123/45 R, 45 A, 123/316

[56] References Cited

U.S. PATENT DOCUMENTS

| | | | |
|---|---|---|---|
| 2,773,490 | 12/1956 | Miller | 123/316 |
| 3,919,986 | 11/1975 | Goto | 123/316 |
| 3,986,351 | 10/1976 | Woods et al. | 123/316 |
| 4,128,085 | 12/1978 | Kunii | 123/316 |
| 4,285,642 | 8/1981 | Komhyr . | |
| 4,403,577 | 9/1983 | Benoaroya . | |
| 4,461,613 | 7/1984 | Moiroux et al. . | |
| 4,570,945 | 2/1986 | Hayashi . | |
| 4,574,749 | 3/1986 | Negre . | |
| 4,576,381 | 3/1986 | Slack . | |
| 4,669,369 | 6/1987 | Holt et al. . | |
| 4,669,736 | 6/1987 | Meijer . | |
| 4,753,198 | 6/1988 | Heath | 123/316 |
| 4,774,917 | 10/1988 | Tokoro . | |
| 4,883,029 | 11/1989 | Winston . | |
| 5,001,965 | 3/1991 | Ruddy et al. . | |
| 5,050,384 | 9/1991 | Crockett | 123/316 |
| 5,441,018 | 8/1995 | Almassi | 123/45 A |

FOREIGN PATENT DOCUMENTS

| | | | |
|---|---|---|---|
| 58-187518 | 11/1983 | Japan | 123/316 |

*Primary Examiner*—Michael Koczo

[57] ABSTRACT

A rotating cylindrical piston engine with a variable effective compression stroke. The present engine shuttles the piston during the power stroke as far as possible in the cylinder to maximize the use of the power provided by the fluid explosion. Since as much as possible of the explosion force is used, i.e., preferably until the exhaust gas reaches ambient temperature or pressure, the exhaust gas is cooler and thus the engine may need no external water cooling, allowing internal air cooling in the cylinder by intake air to be complemented by the cooling with the exhaust gas. Preferably, such linear motion of the shuttling piston over such a great length is converted to rotary motion by forcing the piston to spin in the cylinder as the piston is driven the length of the cylinder. The relative great length of the stroke of the piston captures a great amount of air during the intake stroke, and some of this intake air is expelled during the compression stroke to provide for an effective compression stroke such that the power stroke is of a greater length than the effective compression stroke. The present engine further includes a plate-like cylinder head, a plate like rotary valve, and plate like manifold to provide for a compact head arrangement. The present engine further includes a compression release port which may be opened during the power stroke to permit the piston to act like a brake relative to the power output shaft. The present engine further includes a track and rider arrangement for converting the linear shuttling motion of the piston into rotary motion. The present invention further includes a gear assembly between the piston and a power output shaft for transmitting the rotary motion of the piston to the power output shaft. The present engine further includes a fuel pump assembly, a timing assembly, and an engine isolation arrangement.

12 Claims, 17 Drawing Sheets

120
142
141
144
138
128.2
171
124
122
140
128
146
152
154
156
148
158
161.2
161
76
157
133
170
178.11
161.3
174
178
132
134
130
150
116
160
112
106
104
178.1
126
110
136
128.1
162
164
95
161.1
114
166
92
102
100
178.2
86
87
88
90
108
94
96
98
172
168

ROTATING PISTON ENGINE WITH VARIABLE EFFECTIVE COMPRESSION STROKE

BACKGROUND OF THE INVENTION

The present invention relates generally to internal combustion engines, particularly to such engines which maximize the distance the piston is driven during the power stroke to maximize the use of the power provided by fluid explosion, and specifically to such engines which provide a port for expelling air during the compression stroke for permitting the power stroke to be of greater length than the effective compression stroke.

Conventional internal combustion engines have fixed effective compression strokes, nonrotating cylindrical pistons, cranks, piston rings inwardly of the piston crown, and freed blocks for a particular number of cylinders. These limitations reduce efficiency in various ways which the present invention reduces or eliminates.

SUMMARY OF THE INVENTION

A general object of the present invention is to provide a unique internal combustion engine for maximizing the distance the piston is driven during the power stroke, maximizing the use of power produced by combustion, and maximizing the conversion of linear motion into rotary motion.

Another object of the present invention is to provide a piston which is driven by the fluid explosion as far as possible until ambient pressure or ambient temperature is reached. The exhaust is thus utilized as much as possible, resulting in a cooler exhaust and a more quiet engine.

Another object of the present invention is to provide a port which opens during at least a portion of the compression stroke to permit the power stroke to be longer than the effective compression stroke.

Such objects are provided for by the following preferred features of the present engine:

a) a block and head arrangement with block and head portions, with the block portion having at least one cylinder with an end and a cylinder sidewall, with the cylinder having an axis defining first and second axial directions, with each axial direction defining a piston stroke;

b) a spinning and shuttling cylindrical piston in the cylinder, with the piston having at least a first crown, with the piston further having a piston sidewall being spaced from and in close relationship with the cylinder sidewall, with the piston being shuttleable on the axis in both axial directions and spinnable about the axis in the cylinder, with the piston having intake, compression, power, and exhaust strokes, with the piston including a cylindrical piston body with two ends, with the piston crown fixed to the cylindrical piston body and formed of a material different from the cylindrical piston body, with the material being more durable than the cylindrical piston body, with the piston crown having a front disk shaped face lying at a right angle to the cylinder sidewall, with the from disk shaped face having an integral annular edge with a diameter greater than the piston sidewall with the integral annular edge sufficiently engaging the cylinder sidewall to substantially prevent blowby and to minimize the build-up of undesirable material between the piston sidewall and the cylinder sidewall and increase efficiency;

c) a cylinder head in the head portion and rigidly fixed to the end of the cylinder and being substantially in the form of a plate to provide for a compact block and head arrangement, with the cylinder head being exposed to the front disk shaped face of the piston crown, with the cylinder head being in close relationship with the piston crown during the top of the intake and power strokes to contain explosion of fluid, with the cylinder head further including a first port for intake of air during the intake stroke, a second port for exhausting air during at least a portion of the compression stroke for regulating effective compression stroke length, a third port for optionally permitting air to be drawn in during the power stroke, and a fourth port for expelling exhaust during the exhaust stroke, with the ports of the cylinder head being formed about the axis and circumferentially spaced from each other;

d) first and second closure mechanisms engaged with the cylinder head for regulating the size of the respective second and third ports in the cylinder head, with the first closure mechanism including a first plate for regulating the amount of fluid pushed by the piston out of the second port of the cylinder head during the compression stroke for varying the amount of pressure permitted to build in the cylinder for an effective compression stroke, with the second closure mechanism including a second plate for opening and closing the third port such that the third port is normally closed and such that the third port is opened by the second closure means when the engine is to be used as a brake;

e) a manifold rigidly fixed to the cylinder head opposite of the cylinder, with the manifold being substantially in the form of a plate to further contribute to the compact block and head arrangement, with the manifold including an intake section with a first port for permitting fluid flow to the first port of the cylinder head during the intake stroke, a compression section with a second port being openable during at least a portion of the compression stroke for permitting the piston to push fluid from the cylinder during the compression stroke, with the second port being closeable whereupon pressure begins to build in the cylinder for an effective compression stroke, with the second port of the manifold communicable with the second port of the cylinder head, a power section with a third port which is openable during the power stroke and communicable with the third port of the cylinder head, and an exhaust section with a fourth port for permitting fluid flow from the fourth port of the cylinder head during the exhaust stroke, with the ports of the manifold being formed about the axis and circumferentially spaced from each other;

f) a manifold plate on the manifold for sealing the manifold;

g) a valve mechanism sandwiched between the manifold and the cylinder head for opening and closing the ports by bringing the first, second, third, and fourth ports of the cylinder head into communication with the respective first, second, third, and fourth ports of the manifold, with the valve mechanism being substantially in the form of a plate to further contribute to the compact block and head arrangement, with the valve mechanism including a rotatable structure in close relationship with the piston crown at the top of the intake and power strokes, with the rotatable structure being exposed to fluid explosion causing the power stroke, with the rotatable structure having a periphery concentric with the axis, with the rotatable structure including a port opening, with the port opening communicating with the cylinder and with each of the ports of the cylinder head in turn and the rotatable structure closing off the other ports of the cylinder head when the port opening communicates with one of the ports of the cylinder head, with the port opening being rotatable in sequence from the first port of the cylinder head then to the second port of the cylinder head then to the third port of the cylinder head then to the fourth port of the cylinder head and then back to the first port of the cylinder head;

h) a power output shaft rotatably mounted to the block and head arrangement and trained to the spinning and shuttling piston such that both spinning and shuttling of the piston rotates the power output shaft, with the power output shaft being journaled to the manifold plate, with the power output shaft axially extending through the piston;

i) a gear assembly extending between one of the piston and the power output shaft for rotating the power output shaft in response to rotation of the piston, with the gear assembly including splines extending in a radial direction and an axial, longitudinally extending direction relative to the power output shaft, with bearings on the splines and extending longitudinally along the splines to permit fluid reciprocating movement of the piston in each axial direction on the power output shaft;

j) a compression ignition mechanism in the cylinder for driving the piston in at least one of the axial directions for driving the piston through the power stroke and further comprising means for continuing to drive the piston past a point where energy from the fluid explosion alone no longer is able to drive the piston along the axis such that volume of exhaust gas in the cylinder is increased and thereby cooled prior to the piston being operated in an opposite direction for an exhaust stroke;

k) piston spin mechanism for forcing the piston to spin in one direction of rotation about the axis regardless of the axial direction of piston movement such that both spinning of each piston in the one rotation direction and shuttling of the piston drives the power output shaft, the piston spin mechanism being between the piston and the cylinder, with the piston spin mechanism including an endless track on the piston, with the endless track which may cross itself, but is not required to cross itself, and with the track having at least one curved portion, a rider pivotable relative to the cylinder and including at least three guide pins for engaging the track, with the pins including a leading pin, a medial pin, and a trailing pin engaging the track in such sequence and crossing the intersection in such sequence, with the pins of the cylinder engaging the track in line with each other, and a mechanism for engaging the trailing pin with the track prior to the leading pin engaging the intersection to prevent the rider from pivoting as the rider crosses the intersection, with the mechanism for engaging including another mechanism for disengaging the trailing pin from the track after the medial pin has crossed the intersection to permit the rider to travel on the curved portion of the track;

l) a fuel pump in the block and head arrangement, with the fuel pump having an inlet, an outlet, and a plunger extending therefrom, with a plunger stroke of the plunger controlling the amount of fuel pumped by the fuel pump, with a longer plunger stroke pumping a greater amount of fuel, with a shorter plunger stroke pumping a lesser amount of fuel, with the plunger having a proximal end for operating the fuel pump and a distal end, with the fuel pump further including throttle means for controlling length of the plunger stroke such that the greater or lesser amounts of fuel may be delivered by the fuel pump to the cylinder, with the throttle means including a first gear arrangement trained to the fuel pump and including a first rotatable shaft extending from the block and head arrangement, with rotation of the first rotatable shaft changing the length of the plunger stroke for controlling the amount of fuel delivered by the fuel pump, with the fuel pump having an actuator for initiating the plunger stroke, with the fuel pump having a rotary cam rotatable on the axis and trained to the piston, with rotation of the rotary cam operating the actuator of the fuel pump in association with the piston;

m) a timing mechanism in the block and head arrangement for timing fluid introduced to the cylinder, with the timing mechanism including another mechanism for rotating at least the actuator of the fuel pump about an arc on the axis such that at least the actuator of the fuel pump is advanced or retarded relative to the rotary cam, with the timing mechanism including a second gear arrangement trained to the fuel pump and including a second rotatable shaft extending from the block and head arrangement, with rotation of the second rotatable shaft controlling rotation of the actuator on the arc and thus controlling timing of the fuel delivered by the fuel pump; and n) the engine including an engine control isolation arrangement and another cylinder, piston, cylinder head, closure mechanism, manifold, manifold plate, valve mechanism, power output shaft, gear assembly, compression ignition mechanism for driving the piston in at least one of the axial directions, piston spin mechanism, fuel pump, and timing mechanism, the engine isolation arrangement being on the block and head arrangement and including a first synchronization mechanism engaged to the first rotatable shafts of the throttle mechanisms for synchronizing the first rotatable shafts with each other, a second synchronization mechanism engaged to the second rotatable shafts of the timing mechanism for synchronizing the second rotatable shafts with each other, a third synchronization mechanism engaged to the first closure mechanism for synchronizing the first closure mechanisms with each other, and a fourth synchronization mechanism engaged to the second closure mechanism for synchronizing the second closure mechanisms with each other, with the engine isolation arrangement further including a mechanism for deactivating each of the synchronization mechanisms such that operation of one piston may be maintained while power output of the other piston may be discontinued.

These and further objects and advantages of the present invention will become clearer in light of the following detailed description of illustrative embodiments of this invention described in connection with the drawings.

BRIEF DESCRIPTION OF THE DRAWINGS

The illustrative embodiments may be best described by reference to the accompanying drawings where.

Figure 1A:
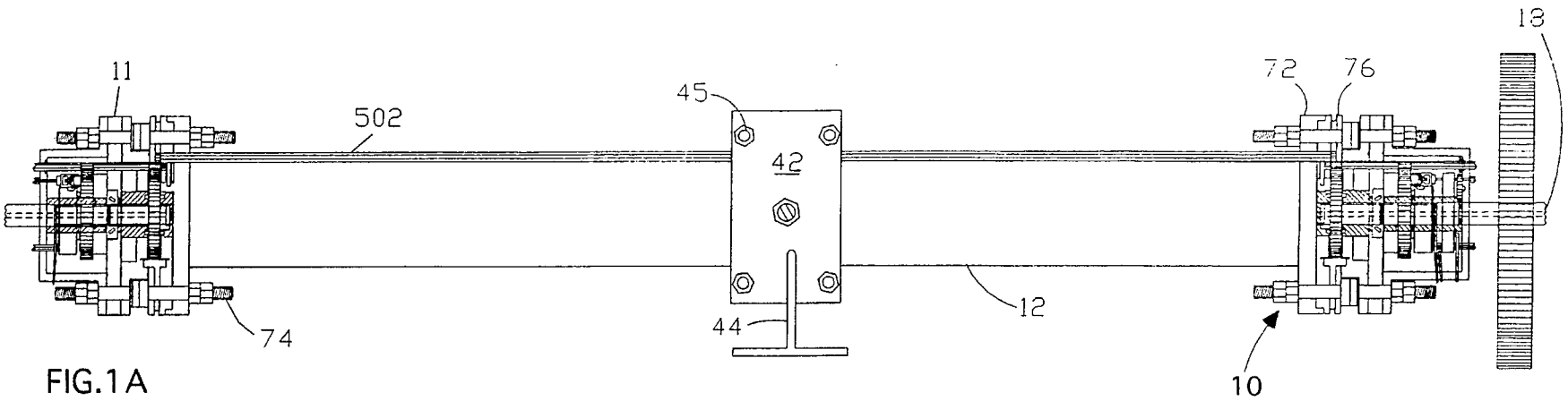
FIG. 1A shows an overall view of the single piston motor with cylinder head portions cut away to further illustrate the layout and design of the motor.

All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various Figures of the drawings, the same numerals designate the same or similar parts. Furthermore, when the terms "axial", "end", "peripheral", "radial", "inner", "internal", "inwardly", "outer", "first", "second", "third", "fourth", "top", a "bottom", and similar terms are used herein, it should be understood that these terms have reference only to the structure shown in the drawings as it would appear to a person viewing the drawings and are utilized only to facilitate describing the preferred embodiment.

DETAILED DESCRIPTION OF THE PREFERRED EMBODIMENTS

1. Shuttling and spinning piston arrangement (linear to rotary motion)

Figure 1B:
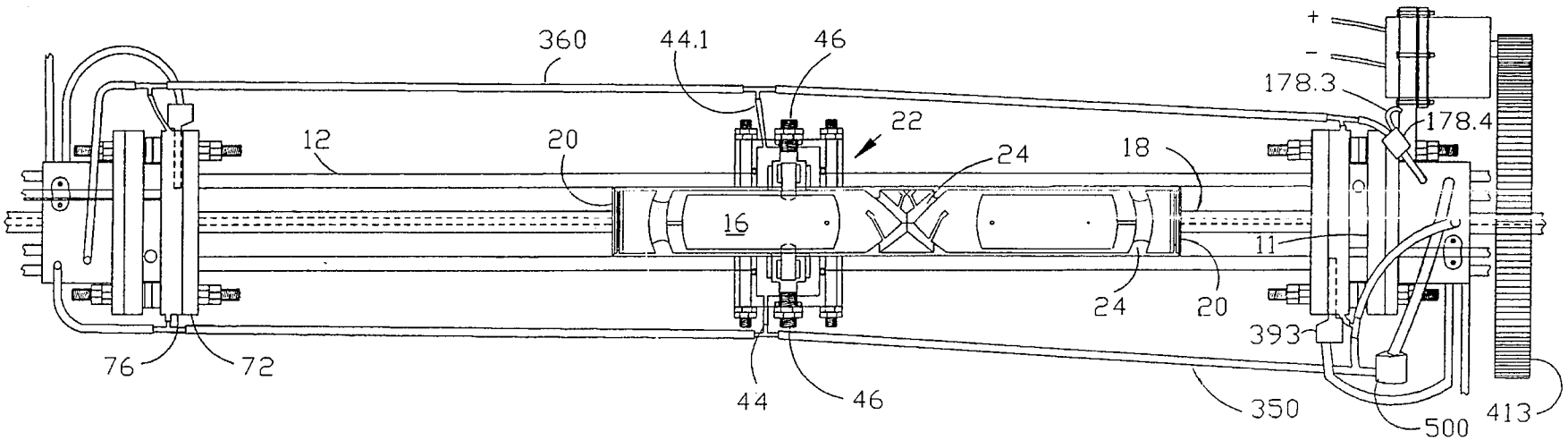
FIG. 1B shows an overall view rotated 90° longitudinally with the interior cut away to illustrate the design and layout of the cylinder interior with guide pin assemblies also cut-away.

As shown in FIGS. 1A–B, the present engine 10 includes at least one block and head arrangement 11 which includes a cylinder or cylinder casing 12. A piston 16 in close relationship with the cylinder 12 is driven from and shuttles end to end in cylinder 12 on a power output shaft 18 which extends axially through the central axis of the piston 16. The piston 16 includes two crowns 20.

As the piston 16 is driven in each of the axial directions, such linear motion is converted to rotary motion in one direction only by a track and rider arrangement 22. The track and rider arrangement 22 includes an endless track or groove 24 formed in the piston sidewall and a guide pin set 26 fixed relative to the cylinder casing 12. As the set of pins 26 engage track 24, the piston 16 is forced to spin about its central axis, thereby imparting a rotary motion to output shaft 18.

Figures 9A, 9B, 9C, 9D:
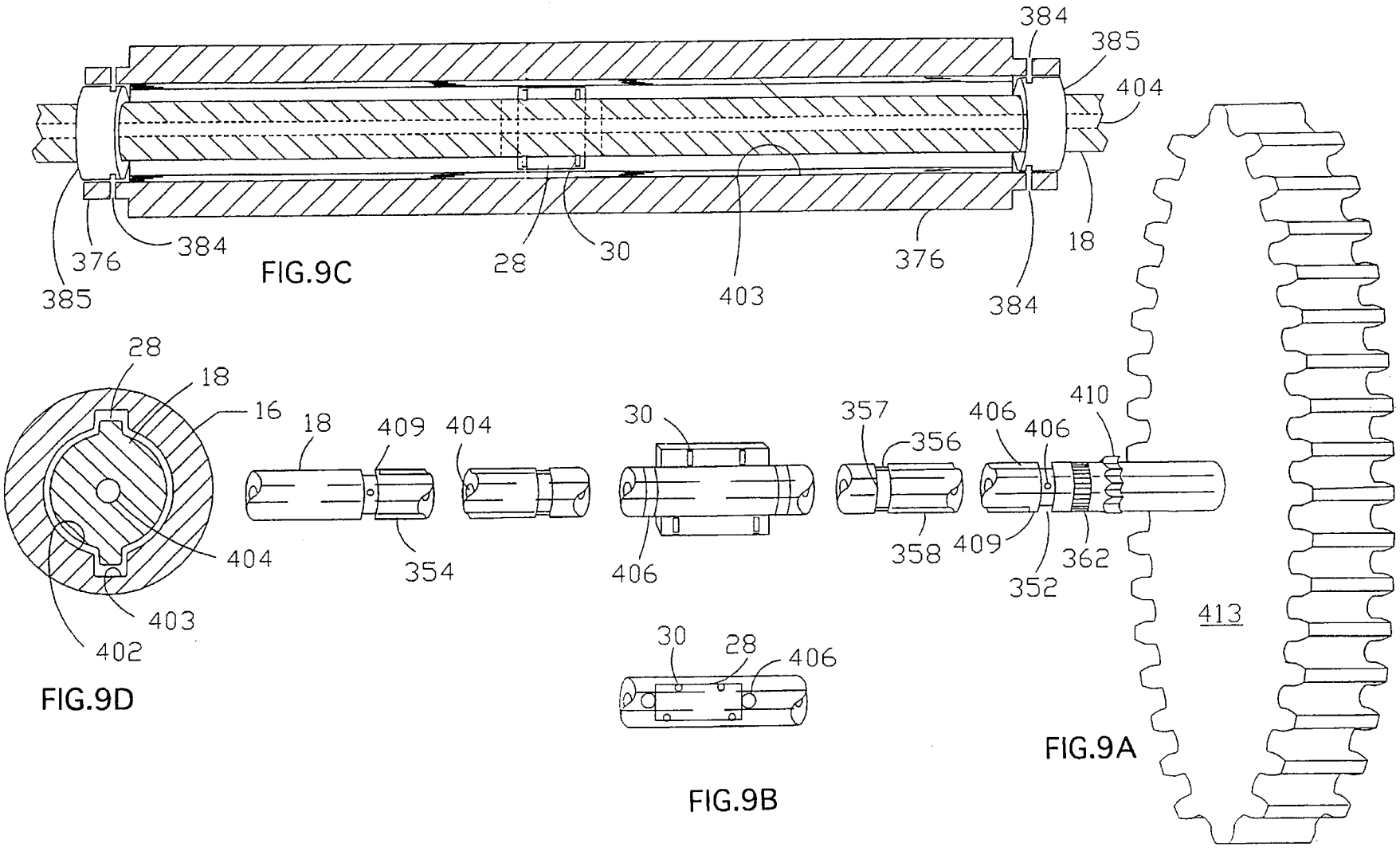
FIG. 9A shows an orthographic view of the main shaft.
FIG. 9B shows a side view of shaft power transfer blades.
FIG. 9C shows a perspective cut-away view of the piston longitudinal interior.
FIG. 9D shows a cross section of piston through the latitudinal center with the main shaft in place.

FIGS. 9C–D show the engagement between piston 16 and power output shaft 18. Blades 28 on power output shaft 18 include rollerbearings 30 to permit the linear or shuttling movement of piston 16 while piston 16 imparts a rotary movement to power output shaft 18.

2. The track and rider arrangement

Figure 2A:
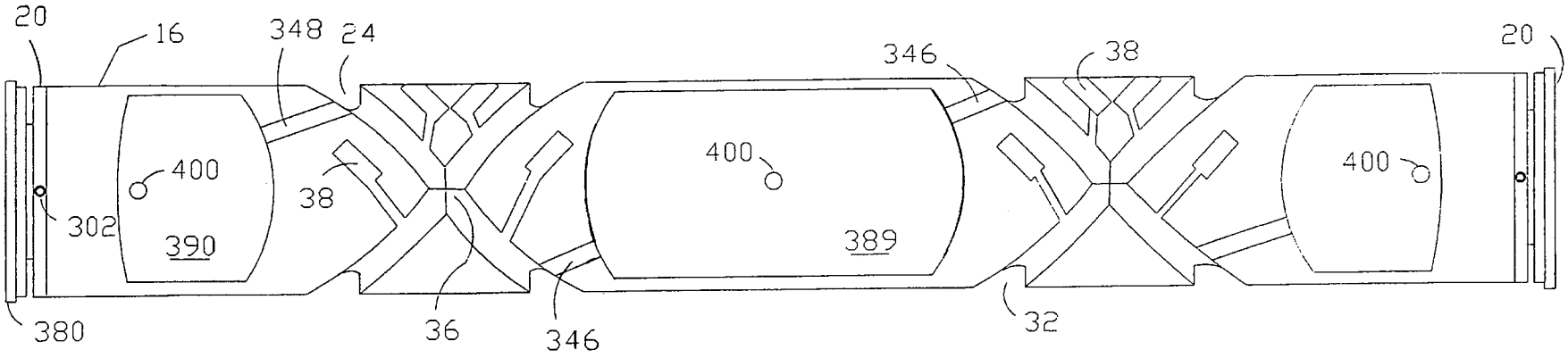
FIG. 2A shows an exterior view of the piston with piston end covers attached without standard piston rings in place.
Figure 2B:
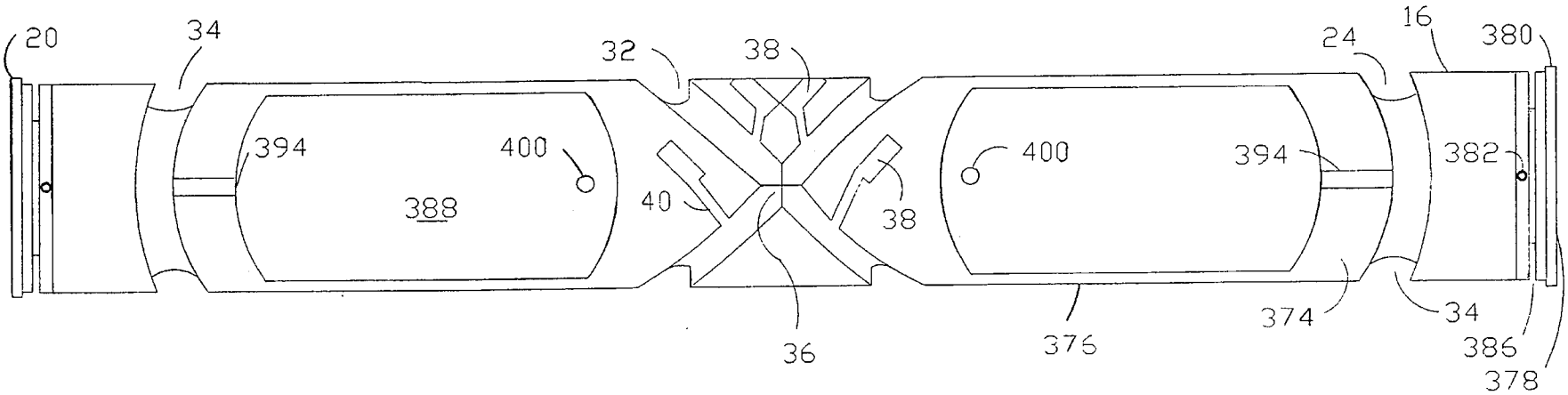
FIG. 2B shows an external view of the piston rotated 90° on its longitudinal axis from FIG. 2A.

As shown in detail in FIGS. 2A–B, endless track or groove 24 is formed in the piston sidewall from substantially one end to substantially the other end of piston 16. Track 24 includes generally linearly extending portions 32 which extend from piston end to piston end at generally a 45° angle relative to the central axis of piston 16 and arcuate end portions 34 at each piston end to interconnect the linearly extending portions 32. The linearly extending portions 32 form preferably six or more intersections or intersecting track portions 36. Running parallel to and spaced from the track 26 are actuating track sections 38. Track section 38 is paired with another track section 38 and are located adjacent the intersection 36. Oil or lubrication inlets 40 extend between track 24 and actuating sections 38 for permitting lubrication from the track 24 to flow into actuating sections 38.

Figure 3C:
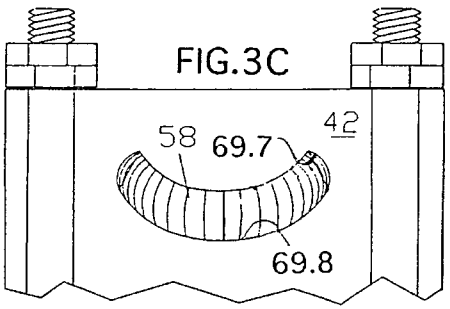
FIG. 3C shows a cut away view illustrating the curved surface for leading guide pin bushing guide of the guide pin mount of FIG. 3B.
Figure 3B:
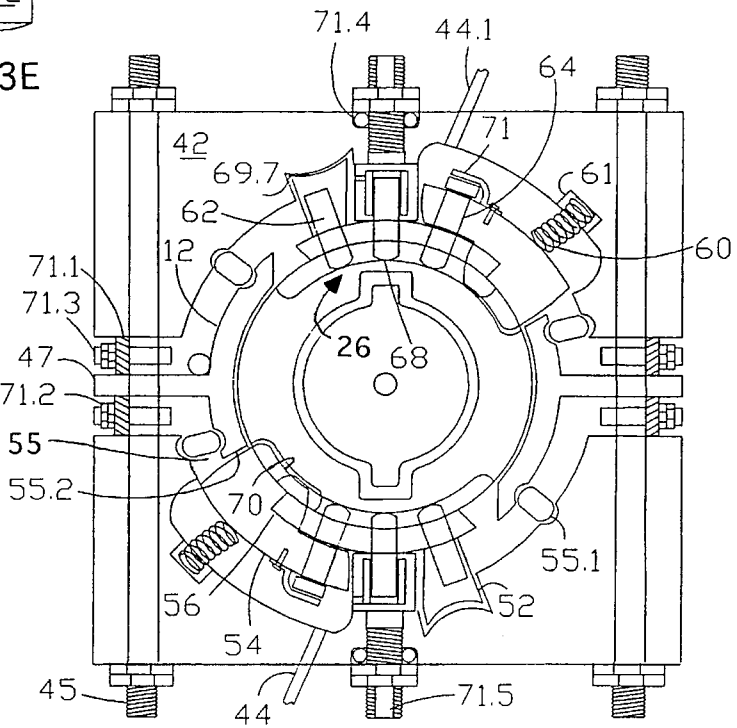
FIG. 3B is a cross-sectional view of the guide pin assembly and cylinder wall and piston 90° relative to FIG. 3A.
Figure 3E:
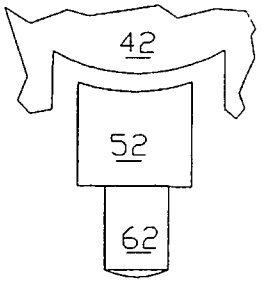
FIG. 3E illustrates the bushing over the leading guide pin.

As shown in FIGS. 1A–B, track and rider arrangement 22 includes a rider housing or mount block 42. An input oil line 44 extends into housing 42 for providing lubrication or oil to the arrangement 22. An output oil line 44.1 extends from rider housing 42. The rider housing 42 is located in the middle of the cylinder 12 such that neither of the piston crowns 20 slide past the track and rider arrangement 22 and such that a sealed cylinder is provided between the piston crown 20 and cylinder head 76. Rider housing 42 is fixed to cylinder casing 12 via bolt arrangement 45. A threaded pin 46 extends into rider housing 42 from either end and is locked by a lock nut 46.1, as shown in FIG. 3A.

The rider portion of track and rider arrangement 22 is shown in detail in FIGS. 3A–D. Integral cylinder protrusion 47 provides the base for bolt arrangement 45. A rider 48 includes a central race and bearing assembly 50 fixed to pin 46 such that turning of pin 46 adjusts the bearing assembly 50 radially relative to piston 16. An oil groove 51 leads into bearing assembly 50. Rider 48 further includes a leading bushing 52, and a trailing bushing 54. Rider 48 is located in cylinder openings 55 sealed by 0-rings 55.1 extending about the openings 55 and pinched between the outer surface of the cylinder casing 12 and the inner surface of rider housing 42. Cylinder openings 55 are formed by cylinder edge 55.2.

A resilient intersection aligner or spring 56 extends between leading bushing 52 and trailing bushing 54. Trailing bushing 54 moves in a radial motion relative to spring 56 and the axis of the cylinder 12. Intersection aligner is preferably a steel spring or a slightly curved spring. Spring or intersection aligner 56 is biased toward a flat plane (and more preferably biased toward a curved shape), but is deformed about the central axis of piston 16 by an inner surface indentation 58 of rider housing 42 engaging leading bushing 52 and by an oval coil spring 60 engaging trailing bushing 54. One end of oval coil spring 60 engages a notch 61 formed on the inner surface of rider housing 42. The other end of coil spring 60 slides on bushing 54.

Leading bushing 52 engages a leading guide pin 62. Trailing bushing 54 engages a trailing guide pin 64. The bearing assembly 50 includes a roller bearing 66 which engages a main guide pin 68. The pins 62, 64, and 68 spin in their respective bushings and bearings to minimize friction with track 24.

Figure 3D:
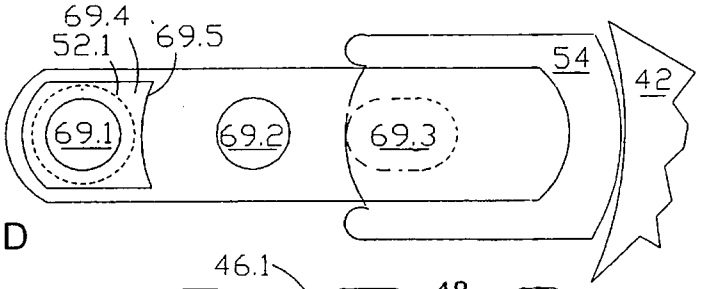
FIG. 3D shows a top view of guide pin aligner with leading guide pin bushing and recess.
Figure 3A:
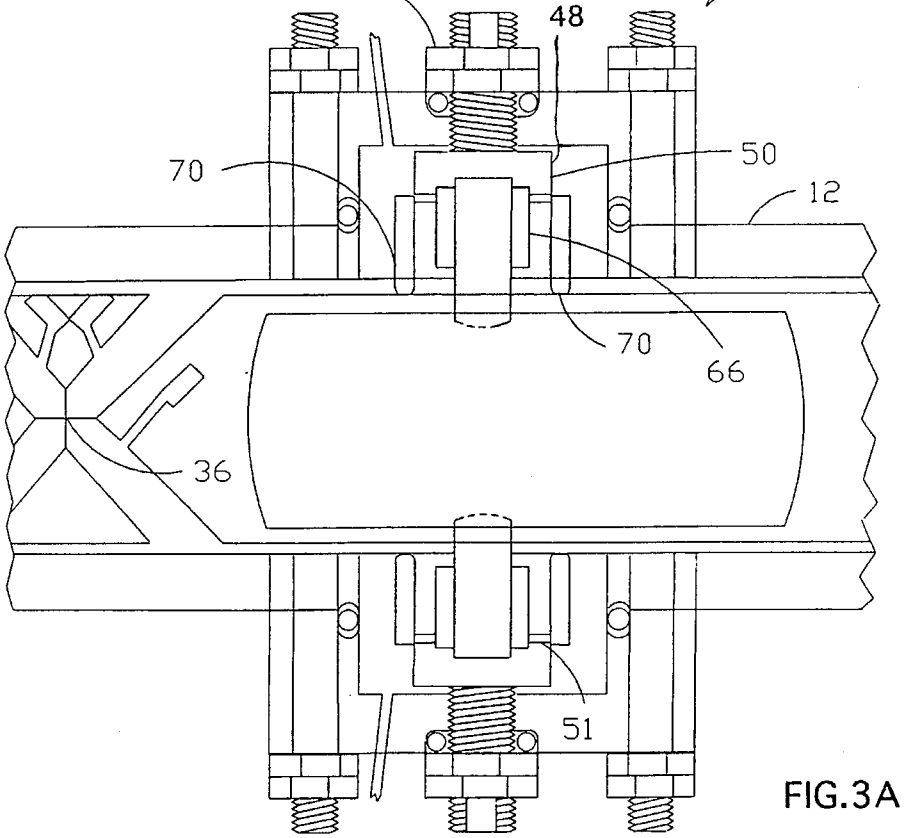
FIG. 3A shows a cross section of the guide pin assemblies with cut off piston in place.

Spring or intersection aligner 56 is shown in FIG. 3D. It includes apertures 69.1, 69.2, and 69.3 for leading, main, and trailing guide pins 62, 68, and 64 respectively. FIG. 3D further shows a bushing head 69.4 of leading bushing 52. Bushing head 69.4 includes curved edge 69.5. Bushing head 69.4 engages indentation 58. Bushing head 69.4 is concave along its length and concave across its width. Indentation 58 and bushing head 69.4 permit spring 56 to pivot smoothly about main guide pin 68 and keep the leading guide pin 62 in track 24 as pin 62 alternatively engages the end portions 34 and linear extending portions 32. Indentation 58 includes a pair of relatively deep portions 69.7 at the ends of indentation 58 and a relatively shallow portion 69.8 in the center of indentation 58. Leading bushing 52 and its head 69.4 engages the end of one of the deep portions 69.7 when leading pin 62 engages any part of linear portion 32 of track 24, leading bushing 52 and its head 69.4 engages the center of shallow portion 69.8 when leading pin 62 engages the center of arcuate end portion 34. It should be noted that spring 56 begins to pivot when leading guide pin 62 begins to enter arcuate end track portions 34. Such pivoting, without a provision such as indentation 58 with its deep and shallow portions 69.7 and 69.8, would tend to draw the head of pin 62 to a greater radial distance from the center of cylinder 12 and thus out of engagement with track 24.

The trailing bushing 54 includes lobes or guide pin actuators 70 extending downwardly therefrom. Lobes 70 engage actuating track sections 38 immediately prior to main guide pin 68 crossing intersection 36 to thereby engage trailing guide pin 64 with track 24. Lobes 70 disengage from actuating track sections 38 immediately after main guide pin 68 crosses intersection 36. When main guide pin 68 crosses intersection 36, spring or intersection aligner 56 engages main guide pin 68 to aid in the travel of pin 68 straight across intersection 36. It should be noted that the sidewall of track 24 forces itself against the sidewall of main guide pin 68 as the linear motion of piston 16 is being converted to rotary motion. Accordingly, main guide pin 68 may have a tendency to skip or jump track 24 when it has no sidewall against which to track. With the engagement of both leading and trailing guide pins 62 and 64 with track 24, main guide pin 68 may bear against an edge defining hole 69.2 in spring 56 through which main guide pin 68 extends. Spring 56 pivots via such hole 69.2 about pin 68 such that leading bushing 52 and trailing bushing 54 also pivot. Such pivoting provides the means for leading and main guide pins 62 and 68 to pass about arcuate sections 34 of track 24. As the rider 48 engages such arcuate sections 34, trailing guide pin 64 travels over the outer sidewall of piston 16.

It should be noted that fixed main guide pins 68 play the main role in the conversion of linear motion to rotary motion and that leading and trailing pins 62 and 64 keep main guide pins 68 engaged in track 24 as pins 68 cross intersections 36. While the present main guide pins 68 or riders 48 are located diametrically opposite each other, three or more guide pins 68 or riders 48 may be used and equally spaced from each other about the central axis of piston 16.

It should further be noted that spring 56 provides at least four functions. First, spring or intersection aligner 56 holds the three guide pins 62, 64 and 68 in a straight line as the main guide pin 68 crosses intersection 36. This function is provided by the lateral rigidity of spring 56 and is unrelated to its longitudinal flex. The engagement of leading and trailing guide pins 62 and 64 in track 24 at the same time prevents spring 56 from pivoting on main guide pin 68 or main guide pin 68 from jumping track 24 as pin 68 crosses one of the intersections 36. Second, the flexing of spring 56 permits guide pins 62, 64, and 68 to be supported as closely as possible to their inner track engaging portions. This support is provided by the edges in spring 56 which form guide pin holes 69.1, 69.2, and 69.3. Third, spring 56 allows pins 62, 64, and 68 to rotate or spin to reduce wear and tear and increase durability. Fourth, spring 56 provides a mount for the bushings 50, 52, and 54 that further permits spinning and stabilizes pins 62, 64, and 68.

It should further be noted that retainer plates 71 fixed to trailing bushing 54 and over the heads of trailing guide pins 64 permit pivoting of pins 64 while keeping pins 64 in bushings 54.

Piston external groove or endless track 24 and guide pin sets 26 (located midway down cylinder length and 180° apart) function to convert the shuttling motions of piston 16 into rotary motion. Oil grooves 40 are used to force oil into piston exterior notches 38 that time the motions of the trailing guide pins actuators or lobes 70 functioning to force actuators 70 to hydroplane thereby reducing hammering as actuators 70 enters and exits notches 38 thereby increasing durability.

Trailing guide pins 64 oscillate in and out of groove or endless track 24 via surrounding actuators 70 passing through notches 38 located near intersections 36 on two sides of groove or endless track 24 but totally outside of the groove 24. Retaining plate 71 respectively located over trailing guide pins 64 and connected to trailing bushing 54 functions to keep the motions of trailing guide pin 64 timed with the motions of actuator or lobe 70.

Trailing guide pin actuator 70 functions to actuate trailing guide pin 64 respectively into and out of endless track 24. Actuator 70 is shaped to avoid entering groove or endless track 24 by its rounded lower edges and its length and the resistance to twisting of spring 56. Actuator 70 passes crosswise, mainly by virtue of its elongate feature, over endless track 24 near the intersection of oil lubrication inlets 40 and linear portions 32. Aperture 69.3 of spring 56 may if desired be slightly elongated for trailing guide pin 64 to pass through to reduce binding of pin 64 and to allow better alignment between pin set 26 and endless track 24 when rider 48 is positioned in cylinder opening 55, as such relative positions may change with changing tolerances due to expansion and contraction of the associated pans.

Piston exterior groove or endless track 24 is a crisscrossing 45° straight groove most of the length of the piston 16 to keep rotary motion one direction. Endless track 24 is further U-shaped or V-shaped or in another suitable shape in section to minimize unsupported groove control while guide pins 62, 64, and 68 are in the intersections 36 and to maximize guide pin contact with sides of groove or endless track 24 thereby functioning to minimize wear of both guide pins 62, 64, and 68 and endless track 24. Additionally, such shapes reduce particulate accumulation; such particulates include combustion debris and metal wear particulates. Linear track portions 32 are straight in order to facilitate smooth crossing of the intersections 36 and to simplify the motions of intersection aligner or spring 56 thereby increasing their durability and simplifying their construction. The curved bottom of groove or endless track 24 can be seen in FIGS. 2A–B. Arc portions 34 near the ends of piston 16 connect the straight grooves portions 32 to provide continuous rotary motion. The groove or track sides of track 24 are of durable material to reduce wear and deformation.

Leading and trailing guide pins 62 and 64, with main guide pin 68 separating them, function to insure smooth crossing of intersections 36. Leading guide pin bushing 52 keeps leading guide pin 62 in contact with the bottom U-shaped surface of endless track 24 and forces continuous contact therewith by virtue of curved indentation or pivot track 58 and allows rotation or spinning of leading guide pin 62. This spinning functions to increase the durability of pin 62 and endless track or exterior groove 24. As shown in FIG. 3C, the curved bottom or inner surface 69.5 may contact race 50 to keep bushing 52 from chattering around leading guide pin 62. Curved surface 69.5 also permits the width of bushing 52 and the width of race 50 to be maximized for strength. Counter sunk bushing aligner recession 52.1 helps to stabilize leading guide pin bushing 52 to thereby reducing binding on guide pin 62.

Intersection aligner or spring 56 functions to keep guide pins 62, 64, and 68 in a straight line thereby enabling smooth crossing of intersections 36. It flexes to allow leading and main guide pins 62 and 68 to slide in endless track 24 and allow trailing guide pin 64 to move in and out of endless track 24 as spring 56 pivots around main guide pin 68 as endless track 24 curves and slides underneath. This motion is strictly due to the curvature of the piston exterior groove or endless track 24 forcing the leading and trailing guide pins 62 and 68 to pivot relative to the sidewall of cylinder 12. The leading and main guide pins 62 and 68 continuously remain in the groove or endless track 24.

Cylinder edge 55.2 which forms opening 55 keeps trailing pin actuator or lobe 70 from bending and twisting trailing guide pin 54 when said actuator 70 moves in and out of notches 38, thereby reducing binding of trading guide pin 64, thereby increasing durability.

Return spring 60 located in notch 61 functions to push actuator 70 into notch 38. The ovular shape of spring 60 keeps spring 60 from becoming misaligned as trailing pin actuator 70 slides under it. Notch 61 retains coil spring 60 thereby contributing to the stability of coil spring 60.

Oil groove 51 helps lubricate roller bearing assembly 50. Lock nut 46.1 engages threaded pin 46 and thus guide pin bearing and race assembly 50 and thereby fixes main guide pin 68 to rider housing 42. The main guide pin 68, race 50, and bearing race extension or pin 46 (all of which operate as a central unit) are located over cylinder aperture 55 at the longitudinal center of the cylinder 12 on both sides 180° apart. The rider housing 42 and the fixing of threaded pin 46 therein function to stabilize main guide pin 68 in piston groove or endless track 24. Pin 46 is fixed to and is part of bearing assembly 50 to press pin 68 into track 24 such that turning pin 46 adjusts main guide pin 68 into or out of endless track 24.

Guide pin mount or rider housing 42 fits over said cylinder casing aperture 55 and is mounted at cylinder length midpoint with bolts 45 attaching through cylinder exterior protrusion 47 located 90° from cylinder aperture 55 and parallel to shaft 18. Spacers 71.1 between mount 42 and cylinder protrusion 47 function to control depth of insertion of rider mount 42 on O-ring seals 55.1 and to keep rider housing 42 square with cylinder 12. Large O-ring seal 55.1 around cylinder aperture 55 and between cylinder 12 and guide pin mount or rider housing 42 functions to keep oil inside cylinder 12. Grooves in guide pin mount or rider housing 42 function to keep O-ring seals 55.1 in place. O-ring grooves in the sidewall of cylinder wall 12 around cylinder apertures 55 functions to align O-ring seals 55.1. Lock nuts 71.2 for C or U-bolts 71.3 located above and below protrusions 47 function to stabilize spacers 71.1 to mounting bolts 45.

O-ring seal 71.4 in guide pin mount or rider housing 42 inward from guide pin lock nut 46.1 functions to keep oil inside cylinder 12. The flat portions 71.5 of threaded pin or guide pin bearing race extension 46 engages a wrench to hold guide pin depth when tightening lock nut 46.1.

Input and output oil lines 44 and 44.1 extend through guide pin mount or rider housing 42.

The wide portion of guide pin bearing race assembly 50 functions to control depth of insertion in piston groove or endless track 24 of main guide pin 68, to control contact pressure of the guide pin aligners 56 against the sidewall of piston 16, and to hold roller bearing 66 which allows main guide pin 68 to rotate thereby increasing durability and reducing friction.

It should be noted that for a large diameter piston the track 24 need not cross itself. In this case, track 24 is endless but has no intersections.

3. The rotary valve assembly

As shown hi FIGS. 4A–B and 5A–7, cylinder casing 12 includes an integral flange 72. Flange 72 is bolted via bolts 74 to a cylinder head 76 having a rotary valve 77, and further bolted to manifold 78, manifold plate 80, and end cover 82. Spacers 84 are disposed between cylinder head 76 and, manifold 78.

3.1 The cylinder head

Figure 4B:
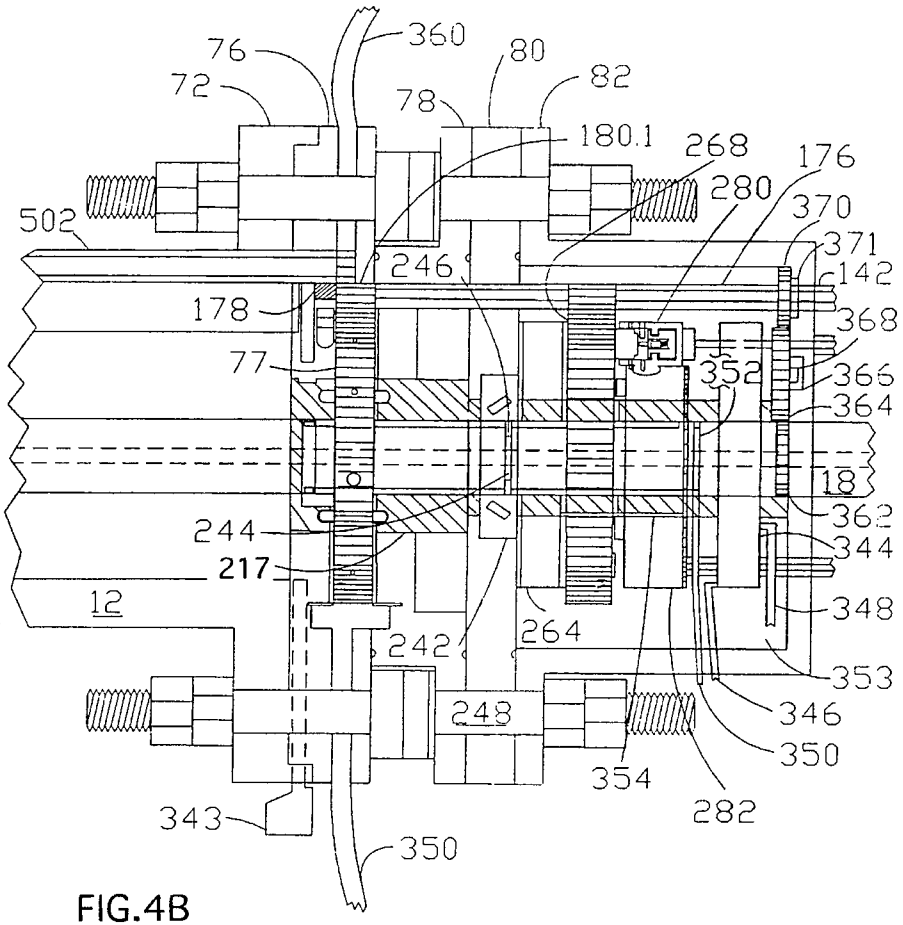
FIG. 4B is a cross sectional view of the oil pump end of the cylinder head assembly illustrating many of the parts that regulate air and fuel flow through the motor.
Figure 4A:
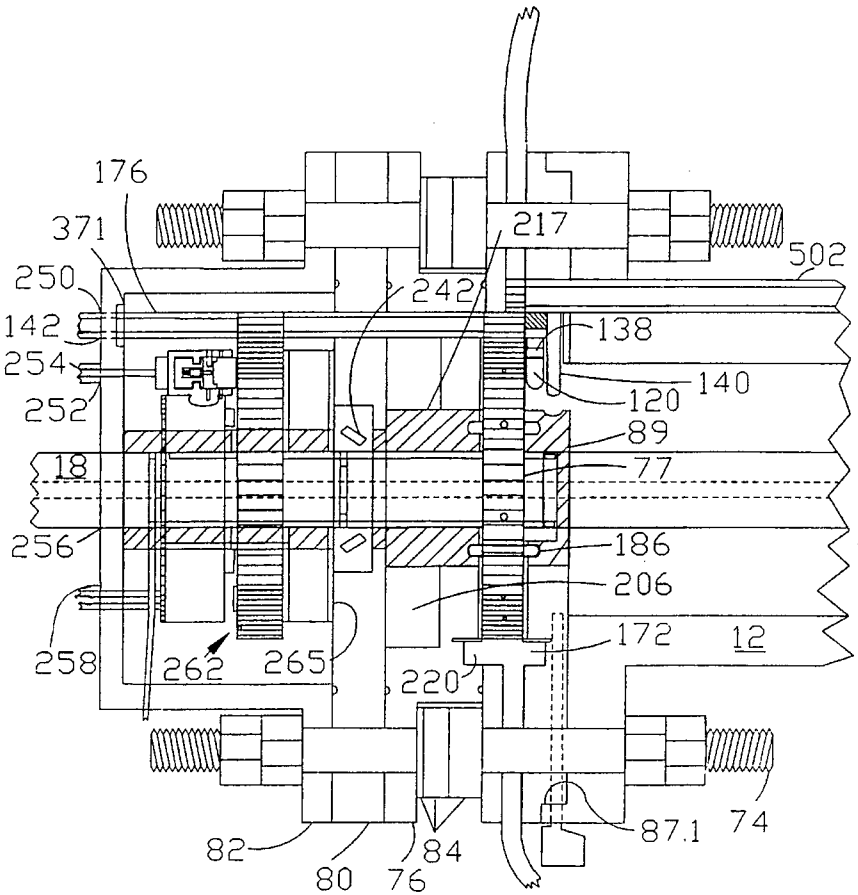
FIG. 4A is a cross sectional view of file non-oil pump end of cylinder head assembly illustrating many of the parts that regulate air and fuel flow through the motor.
Figures 5A, 5B, 5C, 5D, 5E, 5F:
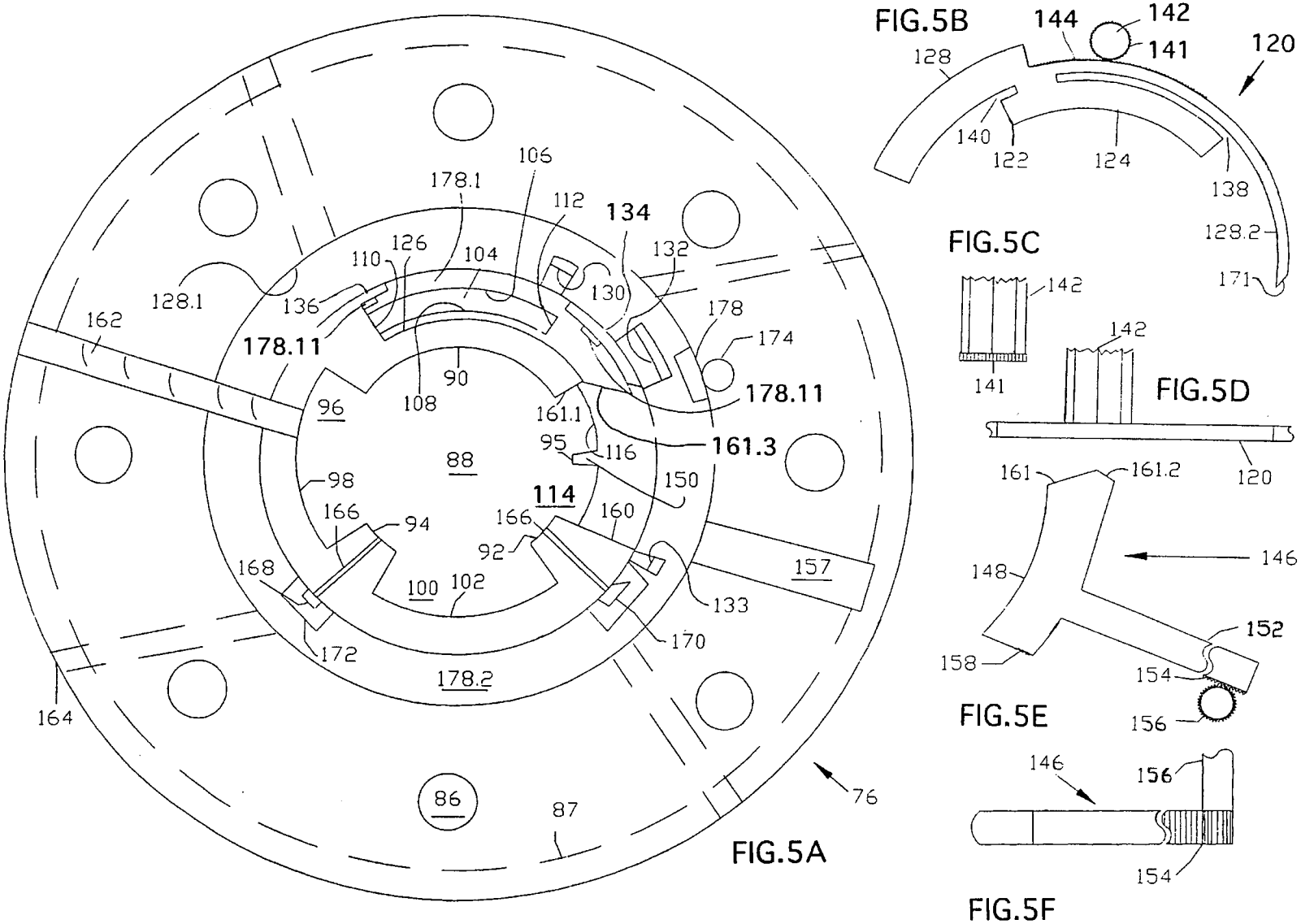
FIG. 5A is an end view of the cylinder head looking toward the cylinder cavity.
FIG. 5B shows a top view of the effective compression stroke variator plate with actuator shaft and its gear teeth.
FIG. 5C shows an actuator shaft with gear teeth for the effective compression stroke variator plate.
FIG. 5D shows a side view of the effective compression stroke variator plate with actuator shaft.
FIG. 5E shows a top view of the compression release plate with actuator shaft.
FIG. 5F shows a side view of the compression release plate and its actuator shaft.

As shown in FIGS. 4A–B and 5A, cylinder head 76, substantially in the form of a plate or disk, includes a plurality of circumferentially spaced apertures 86 for bolts 74 for connection to cylinder flange 72. An annular lip or groove 87 formed in cylinder head 76 mates to a lip 87.1 of cylinder flange 72. Cylinder head 76 further includes a central opening 88 for a bushing 89 and power output shaft 18. Opening 88 is defined by arcuate edges 90, 92, 94, and 95 which engage the bushing 89 for power output shaft 18. Cylinder head 76 further includes an intake port 96 defined by a dovetail edge 98 and an exhaust port 100 defined by a dovetail edge 102. Cylinder head 76 further includes an effective compression stroke port 104 formed by arcuate opposite and parallel edges 106, 108 and end edges 110, 112, and a compression release port 114 formed by a pair of dovetail edges 116.

Compression stroke port 104 may be opened or dosed or the size of port 104 may be varied by a compression stroke variator plate 120, shown in FIGS. 5B–5E. Plate 120 engages cylinder head 76 such that edge 122 of plate 120 closes and opens port 104 and varies the size of port 104. Inner arcuate portion 124 slides against arcuate support edge 126 of cylinder head 76, outer arcuate portion 128 slides against arcuate oil sump edge 128.1, and outer arcuate portion 128.2 slides against support edges 130, 132, and 133 of cylinder head 76. Arcuate extensions or guides 134 and 136 of cylinder head 76 engage respective arcuate slots 138 and 140 of plate 120. Plate 120 is driven by the engagement of a toothed portion 141 of plate control shaft 142 with toothed arcuate edge 144. Control shaft 142 extends out of end cover 82 for control by an operator.

As shown in FIGS. 5F, compression release port 114 is opened and closed by a compression release plate 146 having an arcuate edge 148 concentric with arcuate edges 90, 92, 94, 95 and extending beyond such edges into cylinder head bushing 89 when the port 114 is closed. Edge 148 extends from edge 90 to edge 92. Extension 150 is a support for the plate 146 when the port 144 is dosed. For opening and closing port 114, plate 146 includes an actuator arm 152 with a toothed edge 154 for engaging toothed control shaft 156. Arm 152 slides in groove 157 formed in cylinder head 76. Straight edge 158 of plate 146 engages edge 160 of cylinder head 76 and edge 161 of plate 146 engages edge 161.1 of cylinder head 76 to fully seal port 114. Edge 161.2 of plate 146 rides on edge 161.3 of cylinder head 76 for alignment. Control shaft 156 extends out of end cover 82 for control by an operator.

As shown in FIG. 5A, cylinder head 76 further includes a fuel injection port 162 extending from the circumference of head 76 to intake port 96. Injection port 162 is a bore formed or drilled in the head 76.

Cylinder head 76 further includes a plurality of normally plugged oil drains 164 drilled in head 76 and extending from an inner annular oil sump portion to the circumference of head 76.

Cylinder head 76 future includes two radially extending oil grooves 166 with one way flap valves 168 and 170 permitting oil flow in the outward direction only to oil sump valve chambers 172 in communication with oil sump 178.2. Chambers 172 extend to a greater depth than oil sump 178.2 into cylinder head 76. Flap valve 170 includes a tapered edge for acting as an actuator for an end 171 of plate 120. Oil grooves 166 provide lubrication for rotary valve 77 and effective variator plate 120, which is sandwiched between rotary valve 77 and cylinder head 76. Portions of plate 120 extend over compression release plate 146.

Cylinder head 76 further includes an aperture 174 for power transfer shaft 502 which is driven by a rotary valve control shaft 176. Cylinder head 76 further includes a support 178 for shaft 175.

Effective stroke variator plate 120 located over cylinder head port 104 and riding on surface 178.1 functions to regulate air flow during the compression stroke and is accomplished by opening port 104 in varying amounts which is accomplished by gears 144 on the cylinder head oil sump side powered on shaft 142. Control shaft 142 is aligned perpendicular to plate 120 and parallel to shaft 18 and extends outward through manifold 78, manifold plate 80, and end cover 82 to provide external power input. This is useful as a means of elongating the power stroke relative to the effective compression stroke which functions to increase efficiency until the exhaust temperature reaches intake temperature. Further expansion requires work and hence such a means of elongating the power stroke may be useful as a means of eliminating the heat profile of the engine 10 thus preventing the engine 10 from being visible on infra-red finders or locators.

Slot 138 in plate 120 eliminates misalignment between plate 120 and port 104 while slot 140 performs the same function at its location. Guides 134 and 136 include wedges 178.11 to align plate 120 after insertion and to seal slots 138 and 140 and to keep oil out of port 104.

Extension 128 separates oil from annular oil sump 178.2 and port 104 when plate 120 is in the open position.

Extension or arcuate portion 128.2 is of sufficient length to keep oil out of ports 114 when plate 120 is closed.

All edges that move or contact moving parts are slightly rounded to prevent shaving of rotary valve disk 77 and cylinder head 76. Effective stroke variator plate edge has a slight radius to reduce outward thrust during the power cycle and the resulting vibration and wear of cylinder head 76 and rotary valve disk 77. Effective stroke variator plate 120 is located so as to contact cylinder head groove 126. Furthermore, effective stroke variator plate 120 slides over the compression release plate 146 as effective stroke variator plate 120 opens.

Figure 6E:
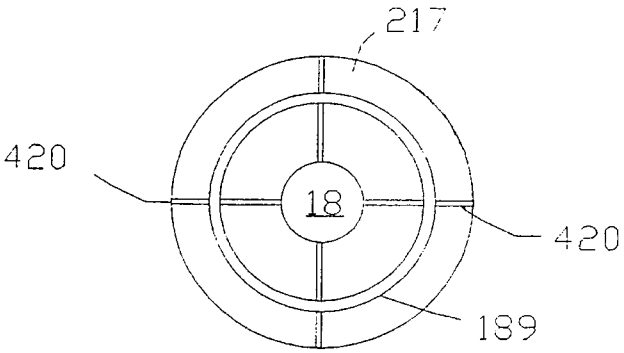
FIG. 6E shows a contact surface of the manifold bushings with the rotary valve with groove for oil interrupter plate.
Figure 6D:
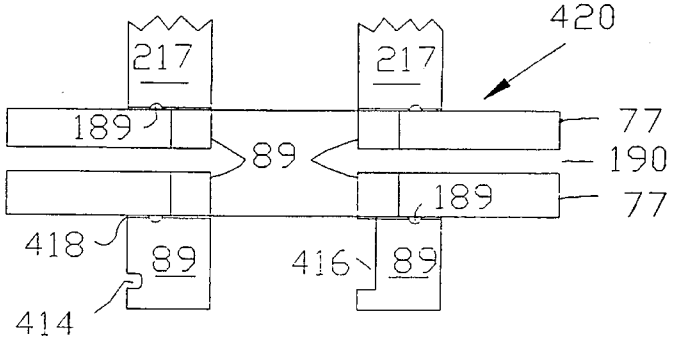
FIG. 6D shows a cutaway view of the rotary valve with manifold and cylinder head bushings in place.
Figure 6C:
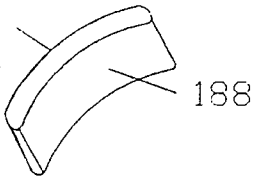
FIG. 6C shows an orthographic view of the oil interrupter plate.
Figure 6B:
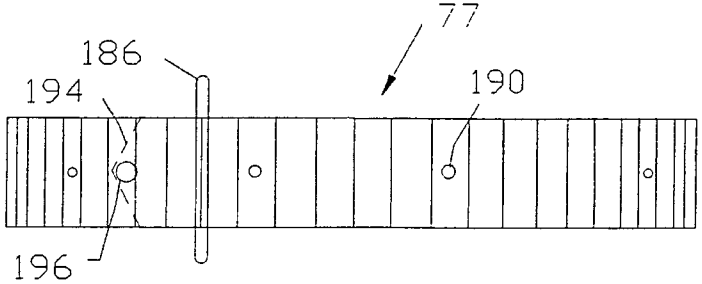
FIG. 6B shows a side view of the rotary valve with oil interrupter plate in place.
Figure 6A:
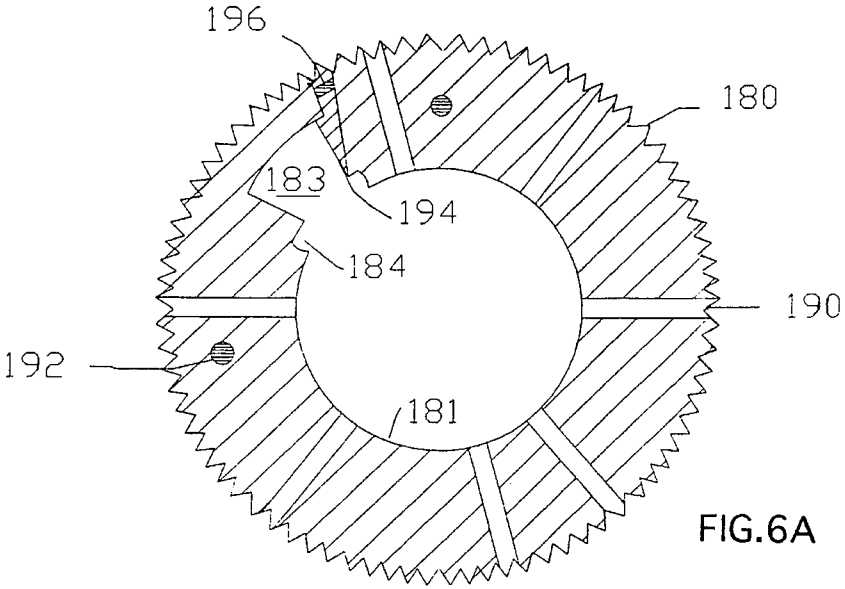
FIG. 6A shows a latitudinal cut-away view of the rotary valve.

Compression release plate 146 coveting compression release ports 114 functions to: 1) release compression during starting multiple cylinder motors on one cylinder; 2) release pressure and suction when running on one cylinder; and 3) when using effective stroke variator plate 120 as a"jake brake" (engine compression brake) to release pressure and suction. Extension 152 with gear teeth 154 located on the side meshes with toothed control shaft 156. Control shaft 156 extends upward and parallel to power output shaft 18. Control shalt 156 further extends outside the end covers to provide an external power input point. End cover 82, manifold plate 80, and manifold 78 stabilize control shaft 156 when it slides compression release plate 146 toward or away from notch or slot 414 (as shown in FIG. 6D) in cylinder head bushing 89. Ends 158 and 161 slide in notches in the quadrant dividers defined by edges 90 and 92 to provide an effective seal from the combustion zone and function to keep compression release plate 120 from vibrating with the various pressures in the cylinder and to keep oil out of ports 114.

Exhaust port 100 extends from quadrant divider defined by edge 92 to quadrant divider defined by edge 94.

The center of the outer surface of each quadrant divider, which engages rotary valve 77, typically have oil grooves 166 which lubricate rotary valve disk 77. It should be noted that quadrant divider defined by reference number 90 may not, if desired, have oil grooves to avoid oil leaking into the cavity of cylinder 12, especially when engine 10 has ceased operation.

Flap valve 170 on the quadrant divider separating compression release port 114 and exhaust port 100 has the clockwise leading edge tapered to accommodate the extension 128.2 when effective compression stroke plate 120 is open far enough to contact flap valve 170. Flap valves 168 and 170 function to keep oil out of cylinder 12 when engine 10 has ceased operation or is run on one cylinder. Hap valves 168 and 170 located in valve chambers 172 and coveting oil grooves 166 keep oil from entering the cavity of cylinder 12 when engine 10 has ceased operation.

Injection port 162 holds fuel injector 343 and extends from the exterior of the cylinder head 76 to intake port 96.

Bolt apertures 86 encircle cylinder head 77 between annular oil sump 178.2 and annular alignment lip 87. Lip 87 is located close to the outer portion of the cylinder head 76 and functions together to align cylinder head 76 with the cylinder flange alining lip 87.1 to hold bolts 74 that keep engine 10 together in the proper alignment.

Oil drains 164 may function as a means to vent blowby, using the uppermost one as the vent and the lowest one as the drain. Another blowby vent 178.3 and oil separator 178.4 are located in the oil return lines and seen in FIG. 1B.

3.2 The rotary valve

Rotary valve 77 is best shown in FIGS. 6A–D. Rotary valve 77 is formed in the general shape of a disk or plate and includes a circumferential toothed edge 180 driven by a set of gear teeth 180.1 (FIG. 4B) on rotary valve control shalt 176. Toothed edge 180 is concentric with an inner edge 181 which engages cylinder head bushing 89 of power output shaft 18. Rotary valve 77 includes port opening 183 formed in the general shape of a dovetail. Port opening 183 is communicable in turn with intake port 96, effective stroke variator port 104, compression release port 114, and exhaust port 100 formed in cylinder head 76.

Port opening 183 communicates with a slot 184 which receives an oil interrupter plate 186. Plate 186 includes an inner edge 188 concentric with and in line with edge 181. Oil interrupter plate 186 extends beyond the faces of rotary valve 77 into an annular groove 189 formed in cylinder bushing 89 and manifold bushing 217 and minimizes oil flow from power output shalt 18 into port opening 183.

Rotary valve 77 further includes a plurality of oil cooling apertures or bores 190 extending radially from inner edge 181 to toothed edge 180. Oil cooling apertures permit oil to cool rotary valve 77.

Rotary valve 77 further includes counter-balancing weights 192 to offset the weight of material taken to form port opening 183 and apertures 190.

Rotary valve 77 further includes an oil channel 194 formed on the trailing edge of port 183 and extending from port opening 183 to toothed edge 180. A one way valve 196 set in channel 194 permits oil flow in one direction only from port opening 183 to toothed edge 180.

Rotary valve disk 77 is located on top or on the outer side of cylinder head 76 and covers effective compression stroke variator plate 120 and compression release plate 146. Rotary valve disk 77 is further located beneath or on the inner side of manifold 78 to time or regulate or control air flow through manifold 78 and cylinder head 76.

Oil interrupter plate 186 located in inner notch 184 of port 183 functions to interrupt oil flow through oil grooves 166 (FIG. 5A)in cylinder head 76 as port 183 passes oil grooves 166 in cylinder head 76 and similarly in manifold oil grooves 218 thereby reducing oil input to intake and exhaust air thereby reducing pollution and periodic maintenance.

Oil interrupter plate 186 includes rounded edges to prevent gouging and shaving of plate 186, of oil groove 189 in manifold bushing 217, and of oil groove 189 in cylinder head bushing 89. It should be noted that oil interrupter plate 186 slides in oil in groove 189 of both manifold and cylinder head bushings 217 and 89.

Oil cooling holes 190 are formed like spokes in rotary valve disk 77 to cool disks 77 and promote oil flow through shalt exterior grooves 354, 358 thereby further insuring adequate oil flow to keep cylinder head bushing 89 cool and clean. These may not be necessary with subsequent production models discarding them.

Counter-balance weights 192 located in rotary valve disk 77 on both sides of port 183 balance rotary valve disk 77 thereby reducing wear and vibration.

The clockwise trailing, radially extending edge of port 183 forming a portion of oil channel 194 collects and directs oil through oil channel 194 to the one way valve 196. One way valve 196 keep s oil in oil sump 178.2 from entering the cavity of cylinder 12 when the engine ceases operation. Oil channel 194 further functions to reduce oil contamination of intake and exhaust air by collecting a percentage of the oil scraped from manifold 78 and cylinder head 76 as the air and oil passes through the moving port thereby reducing pollution and periodic maintenance.

3.3 The manifold

Figure 7B:
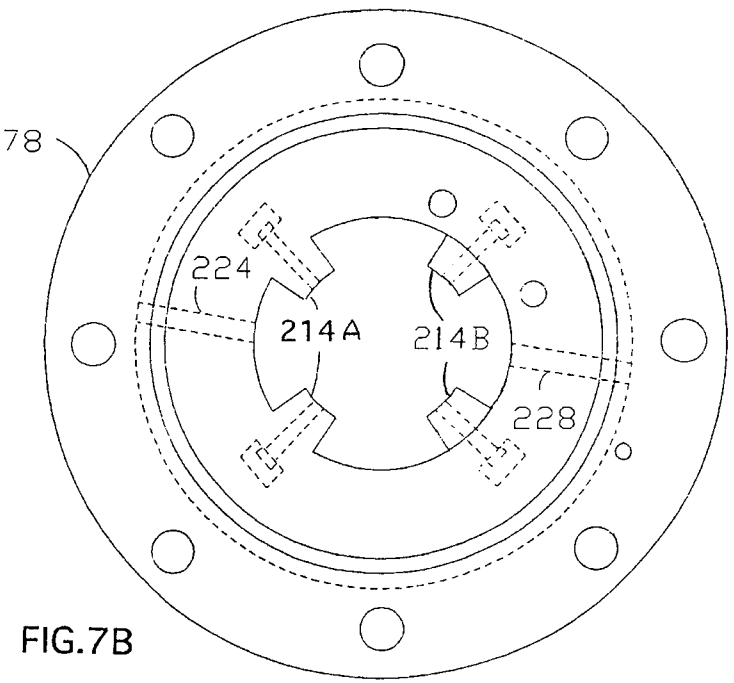
FIG. 7B shows a view of the manifold looking into the cylinder.
Figure 7A:
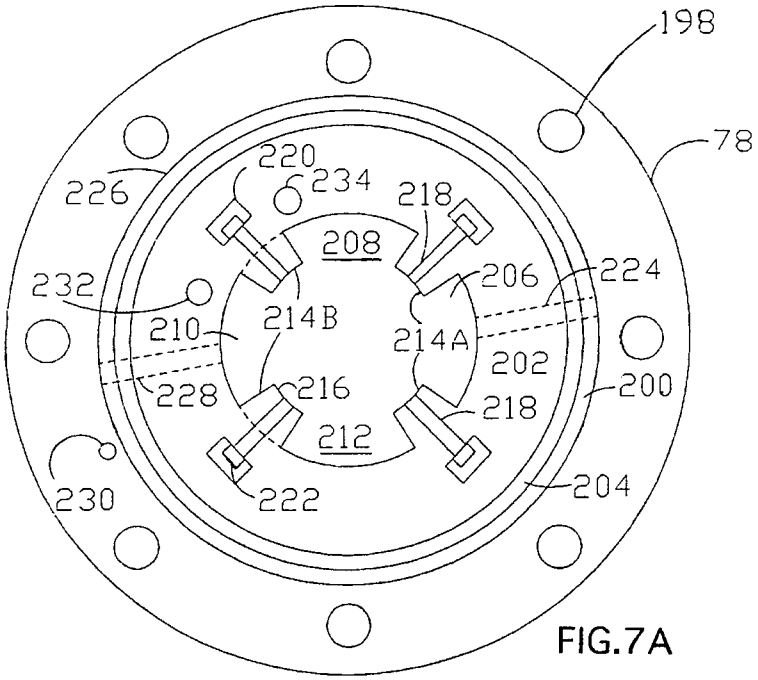
FIG. 7A shows a view of the manifold looking from the cylinder cavity.
Figure 7C:
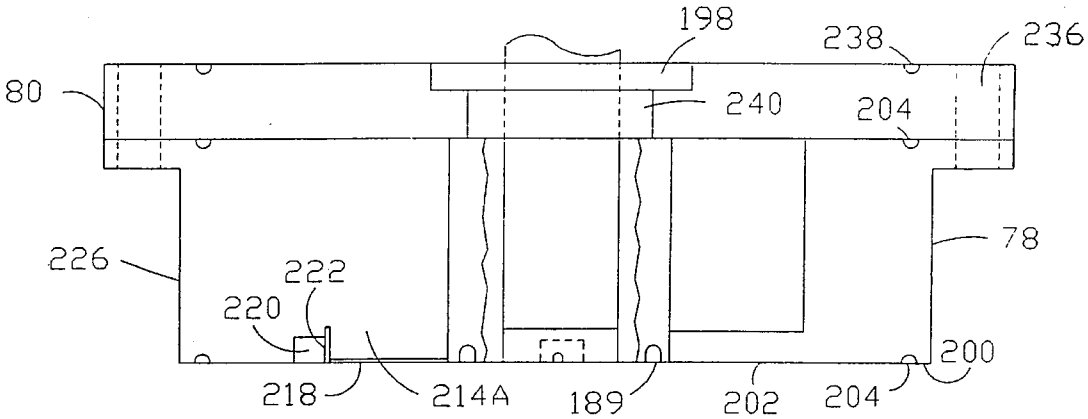
FIG. 7C shows a cross sectional view of the manifold assembly.

Manifold 78 is best shown in FIGS. 7A–C. Manifold 78, substantially in the form of a plate or disk, includes a plurality of circumferentially spaced apertures 198 for bolts 74. Manifold 78 further includes a first annular surface 200 for engaging the cylinder head 76 and a second surface 202 for engaging both the cylinder head 76 and rotary valve 77. Surfaces 200 and 202 lie in the same plane. Between the surfaces is an annular O-ring seal groove 204.

Manifold 78 further includes an intake port 206, effective compression stroke port 208, compression release port 210, and exhaust port 212. Each of the ports 206, 208, 210, and 212 are formed generally in the shape of a dovetail. Manifold 78 further includes quadrant dividers or extensions 214 which include arcuate inner edges 216 for engaging a bushing 217 for power output shaft 18. An oil groove 218 extends outwardly radially from each inner edge 216 to an oil sump or chamber 220. A one way flap valve 222 set in the chamber 220 permits oil to flow only radially outward thereby keeping oil out of manifold 78.

Manifold 78 further includes an intake 224 drilled therein and extending from an annular axially extending wall 226 radially inward to intake port 206. Manifold 78 further includes an exhaust 228 drilled therein and extending from exhaust port 210 radially outward to wall 226.

Manifold 78 further includes an aperture 230 for compression release control shaft 156 for compression release plate 146. Manifold 78 further includes an aperture 232 for rotary valve control shaft 176 and an aperture 234 for effective compression variator plate control shaft 142.

Manifold 78 is located above or outwardly of rotary valve disk 77 and directs air flow. In addition, manifold 78 tensions rotary valve disk 77 to reduce blowby. Tension is adjusted by spacers 84 located around bolts 74 that connect manifold 78 and manifold plate 80 to cylinder head 76. Intake inlet 224 is isolated from the exhaust outlet 228 by quadrant dividers 214 that are adjacent to intake port 206. As shown in FIG. 7C, these adjacent quadrant dividers 214A extend the length of the manifold (from cylinder head 76 to manifold plate 80) and, along with manifold press fit bushing 217, keep exhaust air out of the intake air and vice versa. The other two quadrant dividers 214B, which are adjacent to compression release port 210, extend part way up from the bottom or inner side of manifold 78 to support rotary valve disk 77 and to provide a place for oil grooves 218 which lubricate rotary valve disk 77. Further, since the quadrant dividers 214B which are adjacent to compression release port 210 extend only part of the way in from the inner side of manifold 78, such a termination permits effective compression stroke port 208 and compression release stroke port 210 to communicate with exhaust port 212. This thereby provides an escape route for effective compression stroke variation gasses, compression release gasses and exhaust gasses. Accordingly, exhaust outlet 228 extends directly to compression release port 210 but communicates through port 210 to adjacent ports 208 and 212. Exhaust outlet or port 228 can be located anywhere except between quadrant dividers 214A adjacent to and closing off intake port 206.

Flap valve cavities 220 and flap vanes 222 reduce oil flow into the cavity of cylinder 12 when engine 10 ceases operation and are located at the outer ends of oil grooves 218, and drain oil into cylinder head sump s 178.2. Manifold bushing 217 seals the quadrants dividers 214 from power output shaft 18 and the oil on power output shaft 18.

Manifold plate 80 seals the upper end of manifold 78 from oil and provides the tensioning force from bolts 74 to the manifold 78 which tensions the rotary valves 77 to reduce blow by. O-ring seal grooves 204 are disposed both on the bottom (inner) and on the top (or outer) surface of manifold 78. The O-ring in the groove 204 on the inner side of manifold 78 engages cylinder head 76. The O-ring in the groove 204 in the outer side of manifold 78 engages manifold plate 80. The O-ring between manifold 78 and cylinder head 76 keeps oil inside of engine 10. The O-ring between manifold 78 and manifold plate 80 keeps unfiltered air out of engine 10.

3.4 The manifold plate

Manifold plate 80 is best shown in FIGS. 4A–B and 7C. Manifold plate 80 is generally disk like in shape and includes a plurality of circumferentially spaced apertures 236 for bolts 74. Slightly inwardly from apertures 236 is an annular O-ring seal groove 238 formed in the outer face of manifold plate 80 for sealing oil in end cover 82. A manifold plate bushing 240 for isolating power output shaft 18 from manifold plate 80 is shown in FIG. 7C and may be smaller in diameter than manifold bushing 217. A tapered bearing 242 is set in manifold plate 80 for engaging and permitting rotation of power output shaft 18 and bearing the load of power output shaft 18. FIGS. 4A–B shows a retaining groove 244 for a retaining clip 246 for tapered bearing 242.

Manifold plate 80 supports tapered bearings 242 around power output shaft 18 and transmits end loads to engine 10 through bolts 74 located through manifold plate 80 near the outer edge and parallel to power output shaft 18. It should be noted that manifold plate 80 is isolated from power output shaft 18 by a bushing 240 that seals oil from power output shaft 18 from manifold 78. Manifold plate bushing 240 is located below or inwardly of tapered bearing 242 and may engage or contact manifold bushing 217 which functions similarly in the air chambers of the manifold 3.5 The end cover End cover 82 is best shown in FIGS. 4A–B and forms generally the shape of a hat or receptacle. End cover 82 includes a plurality of circumferentially spaced apertures 248 for bolts 74. End cover 82 further includes an opening 250 for effective compression stroke variator plate control shaft 176, an opening 252 for throttle control shaft 254, an opening 256 for power output shaft 18, an opening 258 for a timing control shaft 260, and an opening (not shown) for compression release control shaft 142.

4. The fuel pump assembly

Disposed within end cover 82 is a fuel pump assembly 262, as shown in FIGS. 4A–B. Assembly 262 includes a disk shaped spacer 264 mounted on a fourth bushing 266 for power output shaft 18. Spacer 264 is disposed between a fuel pump cam disk 268 and manifold plate 80. Each face of spacer 264 engages one of disk 268 and manifold plate 80. Each face of spacer 264 includes radially extending oil grooves 265.

4.1 The fuel pump cam disk

Figures 8A, 8B, 8C, 8D, 8E, 8F:
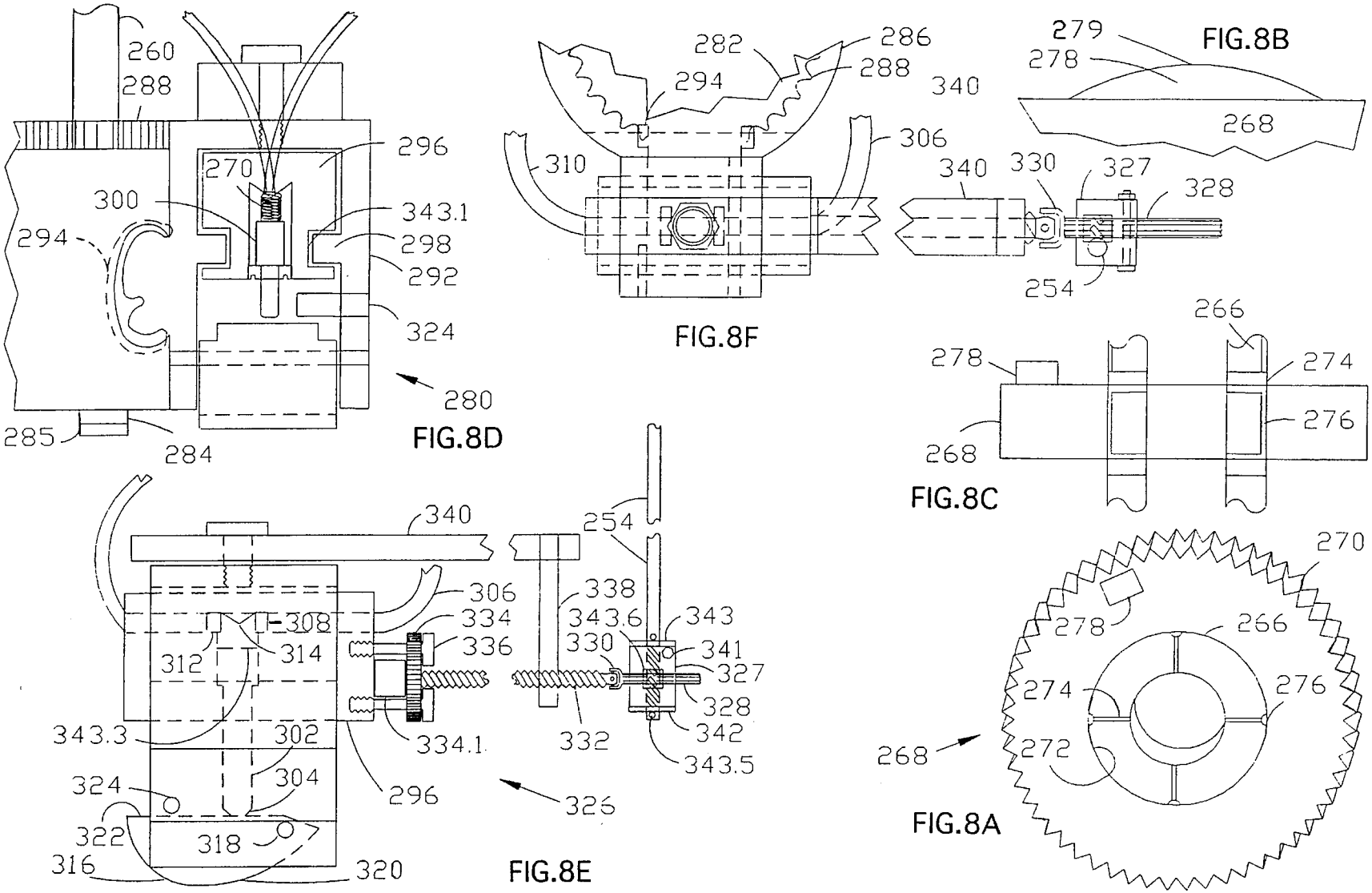
FIG. 8A shows an orthographic view of the fuel pump cam disk with cut away bushing.
FIG. 8B shows a side view of the fuel pump disk cam lobe.
FIG. 8C shows a cross sectional view of the fuel pump cam disk and bushing.
FIG. 8D shows a cut-away view of fuel injector pump and mount.
FIG. 8E shows a side view of injector fuel pump with internal throttle adjustment mechanism.
FIG. 8F shows a top view of injector fuel pump.

Fuel pump cam disk 268 is best shown in FIGS. 8A–C. Disk 268 includes a circumferential toothed edge 270 driven by a set of gear teeth 271 (FIG. 4B) on rotary valve control shaft 176 such that rotary valve 77 and fuel pump cam disk 268 are driven in unison. Disk 268 includes an inner edge 272 engaging bushing 266 for power output shaft 18. Bushing 266 includes radially extending oil apertures 274 which communicate with axially extending oil grooves 276 formed in the exterior of bushing 266. Fuel pump cam disk 268 includes a lobe 278 extending from one face for actuating a fuel pump 280. Lobe 278 includes a raised surface portion 279.

4.2 The fuel pump

A fuel pump mount disk 282 is mounted on bushing 266 and is best shown in FIGS. 4A–B and 8D–F. The disk 282 includes integral spacers 284 extending from one face for engaging fuel pump cam disk 268. Each integral spacer 284 includes an oil flow gap 285. On its other face, fuel pump mount disk 282 includes a toothed gear rim 286 having on its inner edge teeth 288 driven by timing shaft 260.

Fuel pump 280 is mounted to the sidewall of disk 282 via a lobe 290 integral with a casing 292 for fuel pump 280. Lobe 290 engages the sidewall of disk 282 with the aid of ring clip retainer 294.

Fuel pump 280 includes a cylinder casing 296 slideable inside of casing 292 via interior guides 298 integral with casing 292. Inside the cylinder casing 296 is mounted a fuel pump and piston assembly 300 which includes a narrow piston rod portion 302 with a beveled end 304. Here it should be noted that a longer stroke of piston rod 305 of assembly 300 delivers a greater amount of fuel and that a shorter stroke of piston rod 305 of assembly 300 delivers a lesser amount of fuel. Fuel inlet line 306 is fixed to cylinder casing 296 and includes on its distal end a one way valve 308. Fuel outlet line 310 is fixed to cylinder casing 296 and includes on its proximal end a one way valve 312. Disposed between valves 308 and 3 12 is a one piece cylinder interior head 314 which is conically convex to prevent air from being trapped in fuel pump 280.

Fuel pump 280 further includes an actuator or stroke variator ramp 316 for being operated by cam disk lobe 278. Actuator 3 16 is pivotally mounted to casing 292 via pivot pin 318. Actuator 320 further includes a curved surface 320 which engages lobe 278. An opposite surface 322 engages beveled piston end 304 and a return spring 324 for returning actuator 320 to an original position after actuator 320 has been struck by rotating lobe 278. A longer or shorter stroke is delivered to piston assembly 300 by sliding the cylinder casing 296 in fuel pump casing 292 such that piston rod narrow portion 302 is slid toward and away from pivot pin 3 18. When piston rod narrow portion 302 is slid closer to return spring 324, a longer stroke is delivered to and by piston assembly 300 (i.e., the throttle delivers a greater amount of fuel). When piston rod narrow portion 302 is slid closer to pivot pin 318, a shorter stroke is delivered to and by piston assembly 300 (i.e., the throttle delivers a lesser amount of fuel).

As mentioned above, rotary valve 77 and fuel pump cam disk 268 are driven in unison by one control shaft 176. Accordingly, when one lobe is placed on disk 268, the fuel pump 280 is actuated once for every revolution of disk 268. Hence, to time the actuation of fuel pump 280 (i.e., to time injection of fuel), actuator 316 is advanced or retarded relative to lobe 290 by rotation of fuel pump mount disk 282.

Thus it is noted that actuator 316 travels on an arc; however, sliding of cylinder casing 296 in fuel pump casing 292 is linear. Accordingly, sliding of cylinder casing 296 is controlled by a flexible and constant velocity joint or U-joint assembly 326. Flexible and constant velocity joint or U-joint assembly 326 includes throttle control shaft 254, rotation of which through a worm gear housing 327 drives shaft 328 to rotate. Shaft 328 includes a flexible and constant velocity joint or U-joint 330 connected to threaded shaft 332. Shaft 332 engages washer 334 which is fixed to sliding cylinder casing 296 via bolts 336. Rotation of shaft 332 in one direction draws washer 334 toward shaft 254 and rotation of shaft 332 in the other direction pushes shaft end 334.1 against casing 296. Such slides cylinder casing 296 in fuel pump casing 292 to increase or decrease the amount of fuel being delivered to engine 10. Shaft 332 is supported relative to fuel pump casing 292 via housing plate extensions 338 and 340. Shaft 332 threadingly engages extension 338. Throttle control shaft 254 is connected to a worm gear via a bolt 341, retainer 342, and housing 327. Throttle control shaft 254 extends through end cover 82.

Fuel pump 280 is mounted in apertures of fuel pump mount cam disk 282 and functions to pump fuel through fuel injectors 343. The apertures for mounting fuel pump 280 are located on the cut off edge of fuel pump mount disk 282 with retaining clips 294. Fuel pump mount disk 282 pivots around shaft 18 to provide a means of timing and to mount the disk 282. Gear teeth 288 located on outer upper edge of fuel pump mount disk 282 function to allow fuel pump mount disks 282 to pivot when driven by shaft 260, which is located parallel to shaft 18 and extends through end cover 82 which provides support thereto. Timing shaft 260 provides timing control of the engine 10.

It should be noted that fuel pumps 280 in each end of engine 10 are identical except for location and linkage shaft length. Fuel pump 280 includes a housing 292 with protrusion 290 for mounting in an aperture in mounting disk 282. Housing 292 has internal ridges 298, one each on opposite interior sides, to guide fuel pump cylinder 296 in grooves 343.1 formed in the exterior of cylinder 296 exterior to allow cylinder 296 to slide along housing 292 and over end pivoted ramp cam followers 316 thereby adjusting the length of the stroke of fuel pump piston 302 stroke, thereby varying power output of engine 10.

Return spring 343.2 inside cylinder 296 located between conically convex cylinder head 314 and flat piston head 343.3 functions to return narrower portion of piston rod 302 to threaded washer 343.4. The bottom of the piston stroke may be defined when the lower portion of piston head 343.3 contacts with threaded washer 343.4. The conically convex cylinder head 314 functions to positively remove air from cylinders 296 thereby delivering more accurate fuel metering. One way valves 308 and 312 on opposite sides of cylinder head 314 and disposed 180° apart from each other along the direction of travel of cylinder 296 in housing 292 regulate fuel flow.

Bolts 336 in apertures in one end of cylinder 296 mount washers 334 which in turn engage threaded control shaft 332. The other end of shaft 332 includes a flexible and constant velocity joint or U-joint 330, permitting controlled linear and rotary motion to traverse the are fuel pump 280 travels when timing is adjusted. From a stationary source, through the end cover 82, throttle control shaft 254 is located perpendicular to suitably shaped shafts such as splined shafts 328 respectively and connected to shafts 328 through the worm gear in housing 327. Shaft 328 is connected to U-joint 330. Rotary motion from shaft 254 converts to the linear motion of cylinder 296 due to housing extensions 338 located above or beyond fuel pump 280 and connected to housing and encircling threaded shafts 332 through its extensions 340, which is fixed to casing or housing 292.

Thrust bearings 343.5 and bearing stop 343.5 above and below worm gear housing 327 stabilize throttle control shaft 254. Worm gear housing 327 includes a power transmission ring 343.6 (shown schematically).

Bevel 304 on piston rod end 302 functions to insure smooth reconnection with cam follower ramp or actuator 316 after disconnection due to running engine 10 on one cylinder, or starting a multiple cylinder motor on one cylinder. Cam follower ramp 316 is actuated by cam lobe 278 on cam disk 268 as disk 268 rotates. Return spring 324 located adjacent ramps 316 and mounted on housing 292 keeps ramp 316 from chattering, thereby increasing the durability of the parts concerned and delivering more accurate fuel metering.

Integral spacer 284 on bottom of fuel pump mount disk 282 separates fuel pump mount disk 282 from fuel pump cam disk 268 allowing lobe 278 to function. Gap 285 in spacer 284 functions to allow oil flow into the oil sump.

Outer or manifold bushing 266 separate fuel pump cam disk 268, fuel pump mount disk 282, and spacer 264 from power output shaft 18. Oil pump 344 is driven by power output shaft 18.

External longitudinal oil grooves 276 on bushing 266 and perpendicular to and contacting oil holes 274 on bushing 266 and oil inlet grooves 352 on shaft 18 function to lubricate the contact surface of fuel pump cam disk 268 and fuel pump mount disk 282 with bushing 266.

Fuel pump cam disk 268 operates pump 280 through lobe 278 contacting ramp 316 as fuel pump cam disk 268 rotates and is powered by gear teeth 270 located on the outside edge of disk 268 and torqued by gear teeth 271 located on rotary valve control shaft 176 which is disposed perpendicular to disk 268 and parallel to power output shaft 18.

5. Oilpump and oil lines and grooves

As shown in FIG. 4B, an oil pump 344 is mounted on power output shaft 18 between fuel pump mount disk 282 and end cover 82. Oil pump 344 is driven internally by being trained to power output shaft 18. An oil line 346 extends from pump 344 to a filter 500 and an oil line 348 draws oil from a sump 353 to pump 344. An oil line 350 extends from the filter 500 to an oil inlet groove 352 circumferentially formed in power output shaft 18.

As shown in FIGS. 4A–B and 9A–B, from oil inlet groove 352, oil flows to an axially extending oil groove 354 formed on power output shaft 18. Oil then flows axially along shaft 18 to the region of cylinder head 76 where oil impellets 356 in circumferential groove 357 force the oil in the opposite axial direction through axially extending oil groove 358 parallel to and 180° opposite of groove 354. Oil line 350 (FIG. 1B) also extends to cylinder head 76 and to track and rider arrangement 22. An oil return line 360 extends from the opposite side of cylinder head 76 to the oil sump 353 (FIG. 1B) and may vent blowby via air/oil separator 178.4.

6. The reduction gear train

As shown in FIGS. 4A–B, power output shaft 18 includes a circumferentially extending toothed gear portion 362 which drives an idler gear 364. Idler gear 364 includes an idler gear bushing 366 and an idler gear shaft 368. Idler gear 364 in turn drives toothed gear 370 fixed to and driving rotary valve control shaft 176. Bushing 371 located just within end cover 82 supports control shaft 176. It should be noted that rotary control shaft 176 is supported at its other end by support 178.

7. The piston

Piston 16 is best shown in FIGS. 2A–B. As mentioned above, piston 16 includes two piston crowns 20. Piston 16 further includes a piston sidewall 374 spaced from and in close relationship to the sidewall of cylinder 12. Piston crowns 20 are formed of a material different from piston body 376, with the material being more durable than piston body 376. Piston crown 20 includes a front disk shaped face 378 exposed to cylinder head 76 and lies at a right angle to the sidewall of cylinder 12. Face 378 includes an integral annular edge 380 with a diameter greater than the piston sidewall 374. Edge 380 sufficiently engages the sidewall of cylinder 76 to substantially prevent blowby and to minimize the build up of undesirable material between the piston sidewall 374 and the sidewall of cylinder 76. Piston crown 20 includes an aperture 382 which engages an annular retaining clip located in an annular groove 384 shown in FIG. 9C and spaced from an end 385 of piston body 376 to mount the piston crown 20 to the piston body 376. As shown in FIG. 9C, piston crown 20 may be set over a greater axial portion of piston body 376 than is shown in FIG. 2A–B. Piston 16 further includes one or more compression ring mounting annular grooves 386 spaced from and adjacent to front disk shaped face 378 for mounting one or more compression rings. The groove 386 lies at a right angle to the sidewall of cylinder 12 and mounts a compression ring to engage the sidewall of cylinder 12 such that said compression ring or scraper ring has the same diameter as annular edge 380.

As shown in FIGS. 2A–B, piston sidewall 374 may include shallow depressions 388, 389, and 390 for the collection of oil therein. Depression 388 is formed between arcuate track portion 34 and a middle portion of piston 16. Depression 389 is formed between two intersections 36. Depression 390 is formed 90° opposite to arcuate track portion 34. Each depression 388, 389, 390 has a width about 90° transversely about piston sidewall 374. Each depression 388, 389 has an axial length at least more than twice its width. Each depression 390 has an axial width about equal to its height. Each depression 388, 390 has a cylindrical surface 392, concentric with piston sidewall 374, which is set in from piston sidewall 374 and in close relationship with the sidewall of cylinder 12. The depressions 388, 389, 390 function to cool, lubricate, and clean the cylinder 12.

An oil groove 394 runs from depression 388 to arcuate track segment 34. Two oil grooves 396 run from opposite sides of depression 389 to respective portions of track 32. Oil groove 398 runs from depression 390 to a portion of track 32.

As shown in FIGS. 2A–B, piston 16 is generally cylindrical in shape. Oil apertures 400 run from an interior sidewall 402 of piston 16 to the outer surface of piston 16 to exit in one of depressions 388, 389, or 390. Interior sidewall 402 includes an axially extending channel 403 for blades 28 of power output shaft 18. Piston end 385 is rigidly fixed in each end of piston 16 and groove 384 is partially formed in end 385.

Piston ring crown faces 378 located one at each end respectively of each piston 16 function to reduce the non combustion zone of cylinder 12. Attachment means such as wire retainers extend through apertures 382 and further extend in apertures or annular grooves 384 formed in piston ends or power output shaft bushings 385 thereby keeping all piston parts fitted together and the oil inside piston 16 separate from combustion gases.

Top or outer piston rings or crown annular edges 380 functions to reduce the non combustion zone to the space between the cylinder sidewall and cylinder head 76. Conventionally, piston rings are set off from the piston crown such that undesirable material becomes lodged between the piston sidewall and the cylinder sidewall. The present invention avoids this, thereby increasing efficiency and reducing pollution. Attachment means such as the wire retainers mentioned above are located beneath or inwardly office lowest or innermost standard piston ring annular grooves 386. The rest of the piston crown or piston assembly 20 has the same outside diameter as piston sidewall 374 except for grooves 386 that accept standard type piston rings, and excluding the top or upper rings or crown annular edges 380 which have a slightly larger diameter than piston sidewall 374 thereby reducing blowby.

Piston internal grooves or channels 403 located over shaft blades 28 transfer energy from the combustion zone through the piston to shaft 18. The depth of grooves 403 is greater than the height of shaft blade 28 to allow oil to pass as piston 16 shuttles.

Piston external indentations 388 hold oil to cool and lubricate piston 16 and the cylinder sidewall. Oil apertures 400 in piston exterior indentations 388 transfer oil from inside piston 16 to exterior 388 for cooling, cleaning, lubrication and circulation. Oil grooves 394 from indentations 388 transfer oil to piston exterior groove portion 34 functioning to improve oil circulation around piston 16 and cylinder 12.

8. Power output shaft

Power output shaft 18 includes blades 28 and roller bearings 30 and is best shown in FIGS. 9A–D. Blades 28 run in channels 403 of piston 16. Roller bearings engage the sides of channels 403. Power output shaft further includes a radially extending oil inlet 403.1 extending from circumferential groove 352 (shown in FIGS. 2C and 7) to communicate with an axially extending oil line 404 which in turn communicates with radially extending oil line 406 running to the exterior of power output shaft 18 to exit adjacent shaft blades 28 which mount roller bearings 30. As shown in FIG. 9B, roller bearings 30 are disposed on either side of blade 28 and may be staggered relative to each other.

It should be noted that FIG. 9A shows the exterior axially extending oil grooves 354 and 358. Oil flows in feed groove 354 from circumferential groove 352 to circumferential groove 357 where the oil is returned by impellers 356 in return line 358 which terminates just short of circumferential groove 352. This termination or plug 409 ensures that used oil is not mixed with freshly filtered oil as well as ensuring a positive flow in one direction such as through bushings 89, 266, rotary valve 77, and fuel pump cam disk 268. FIG. 9A further shows the takeoff gear portion 362 which through idler gear 364 and control shaft 176 drives rotary valve 77 and fuel pump cam disk 268.

Power output shaft 18 further includes a sprocket 410 for a chain 412 for interconnecting power output shafts 18. Power output shaft 18 further includes a flywheel 413.

Shaft 18 is the longitudinal axis of engine 10 and is connected to the engine from each end by end covers 82 at one end and 448 (FIG. 12) at the other end. Shaft 18 and end covers 82 and 448 function to contain oil and align the parts regulatng air and fuel flow. Shaft midpoint blades 28 function to transfer power from the pistons' internal grooves or channels 403 to the output shaft 18. Roller bearings 30 in shaft blades 28 function to reduce friction and increase durability. Ring clips retain the bearings 30 in place in blades 28. Oil groove 404, the longitudinal center of shaft 18, functions to pass lubricating oil to the interior of pistons 16 through oil outlet ports 406 and in shaft 18 at either end of blades 28. Oil grooves 352 located respectively at each end of shaft 18 between the oil pump 344 and fuel pump mount disks 282 at one end and fuel pump mount disks 282 and the end cover at the other end of shaft 18 receives oil from the oil filter 500 functioning to input oil into the shaft 18 through apertures 403.1 located at respective ends of shaft 18, while external grooves 358 in shaft 18 function to lubricate shaft manifold bushing 217, cylinder head bushing 89, fuel pump cam disk 268, rotary valve 77 and tapered bearings 242. Two plugs 409 located in or at the end of oil grooves 358 function to force a higher oil flow rate which ensures adequate cooling and lubrication of cylinder head bushings 89.

Oil impellers 356 located in shaft grooves 357 at cylinder head bushings 89 force oil from cylinder head bushings 89 through bushing grooves 418, 420, 416, 189, 218 then through oil grooves 166 in the quadrant dividers through flap valves 168, 222 and 170 to cylinder head sumps 172.

Reduction gear drive or toothed gear portion 362 located just inside end cover 82 on shaft 18 functions to drive idler gear 364 which functions to drive gear 370 on shaft 176 that drives rotary valve disk 77 through gear teeth 180.1 and fuel pump cam disk 268 through gear teeth 271 functioning to properly cycle respectively air and fuel.

Shafts 176 that drive rotary valves 77 and fuel pump cam disks 268 at their respective ends of engine 10 are located parallel to shaft 18 between end covers 82 and 448 and mesh with gears 270 and gears 180 respectively.

Rotary valve control shaft 176 is supported at both ends by end cover bushing 371 at one end and cylinder head support 502 at the other end and in the middle by manifold 78 and in manifold plate 80.

Gear teeth 271 are located in line with fuel pump cam disk 268 functioning to transfer power from shaft 18 through shaft 176 through gears 271 to fuel pump cam disks 268.

Gear teeth 180.1 are located on the cylinder head end of rotary valve control shaft 176 and transfer power to rotary valve 77.

Flywheel 413 located at on the oil pump end of shaft 18 functions as power takeoff, engine pulse dampener, and starter input.

9. Power output shaft bushings

Power output shaft bushings 89 and 217 are shown in FIGS. 6D. Cylinder head bushing 89 includes a groove 414 for receiving the inner arcuate edge 148 of compression release plate 146 to seal off compression release or power port 114. Cylinder head bushing 89 further includes an oil return notch 416 which is aligned with impellers 356 of power output shaft 18. Cylinder head bushing 89 further includes the annular groove 189 for oil interrupter plate 186. Cylinder head bushing 89 further includes radially extending oil grooves 418 adjacent to rotary valve 77.

It should be noted that cylinder head bushing 89 is also the bushing for rotary valve 77. It should be noted that annular groove 189 for oil interrupter plate 186 is formed in both cylinder head bushing 89 and manifold bushing 217. Manifold bushing further includes radially extending oil grooves 420 adjacent to rotary valve 77 and cylinder head bushing 89.

10. Frame features

Figures 10A, 10B, 10C, 10D:
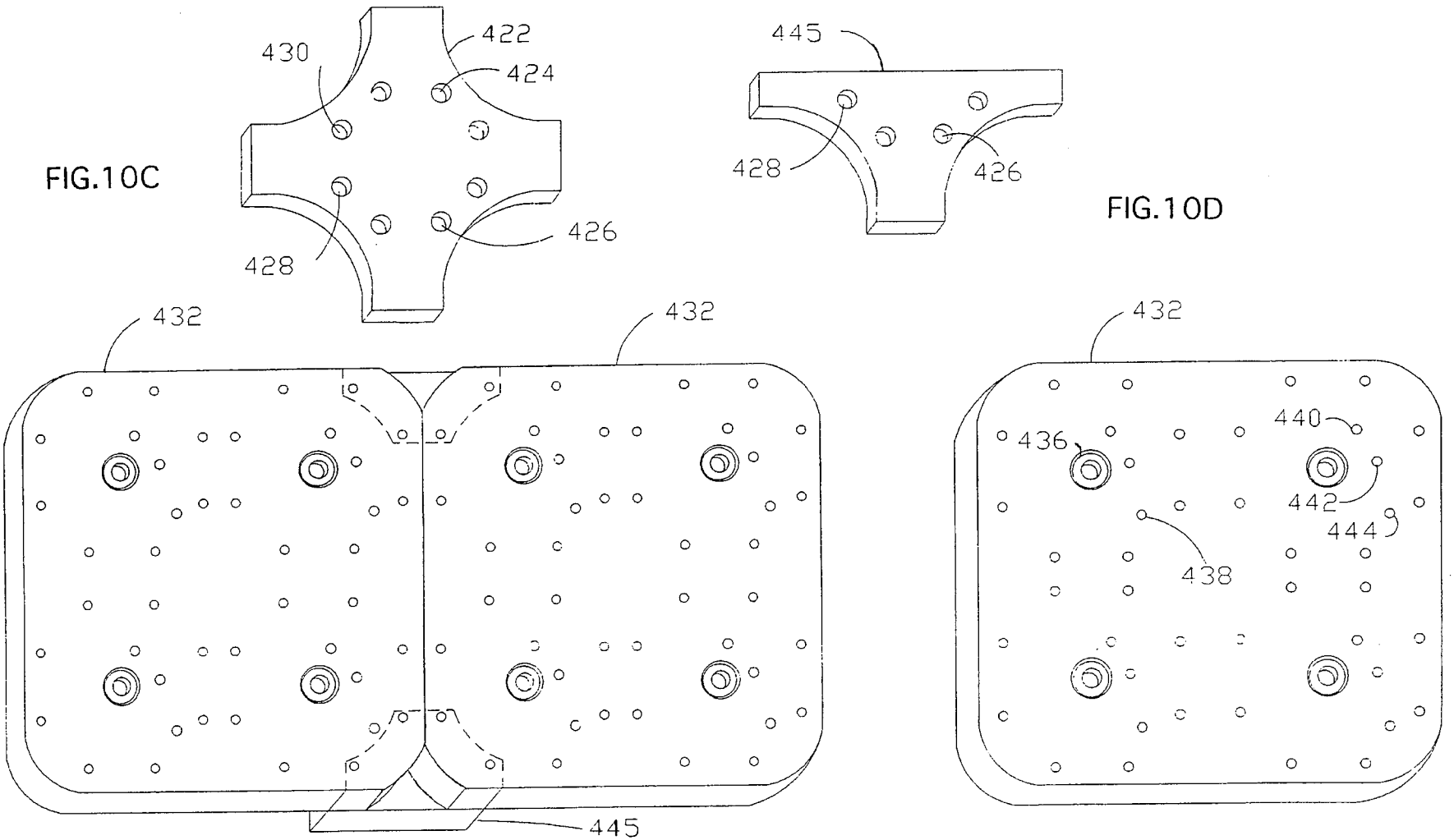
FIG. 10A shows a view of the single four cylinder block manifold plate combination for a four piston motor.
FIG. 10B shows the engine block manifold plate combination for two blocks with connector plates.
FIG. 10C shows the interconnectors for multiple cylinder and multiple block arrangements.
FIG. 10D shows a perspective view of one-half of an end plate.
Figure 12:
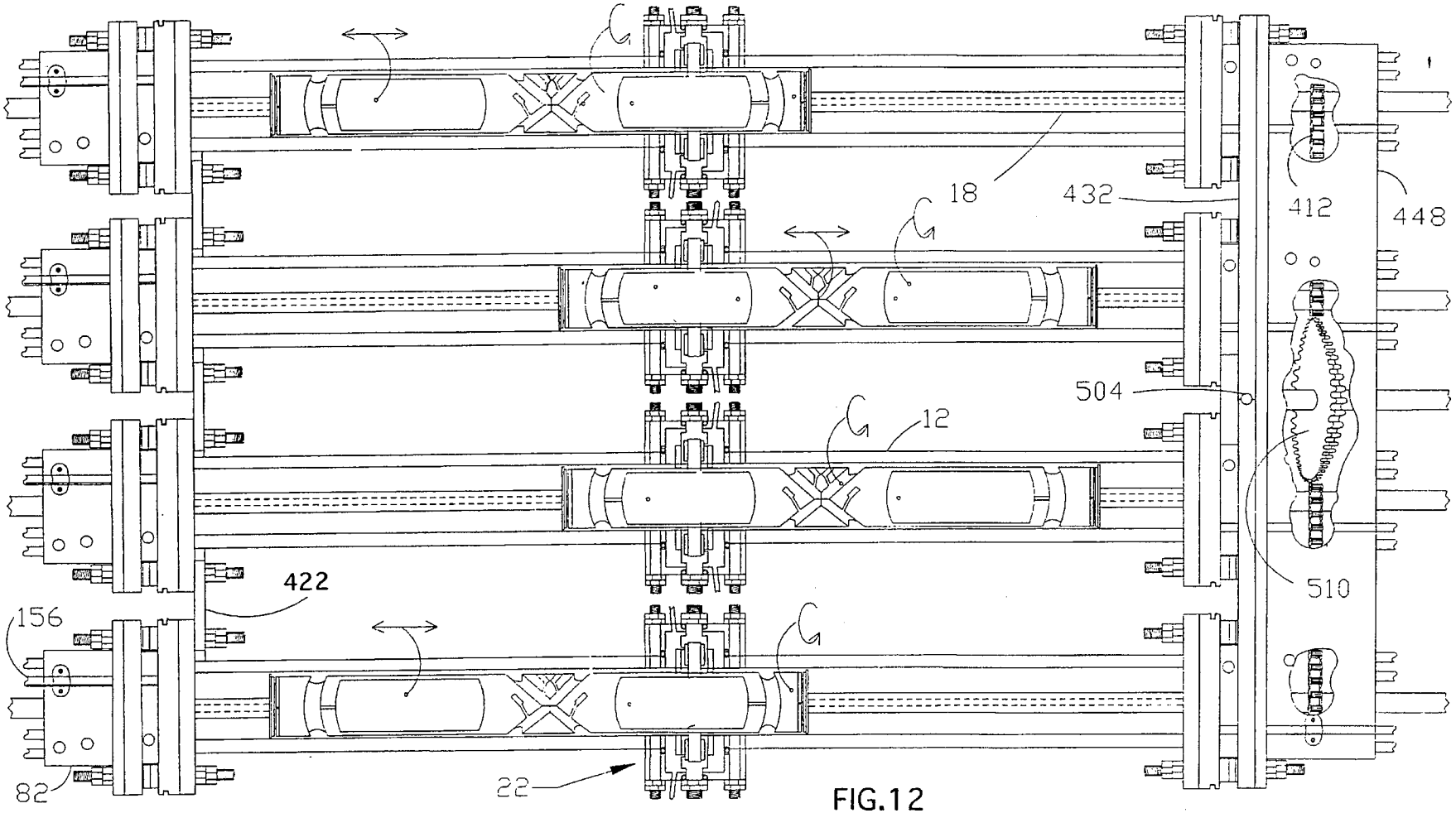
FIG. 12 shows an overall view of the multiple cylinder arrangement of two blocks of four cylinders (the other four cylinders are behind the front ones) illustrating vibration reduction by timing pistons in groups of two and illustrating the position of the idler sprocket and the position of the shaft interconnecting chains.
Figure 13A:
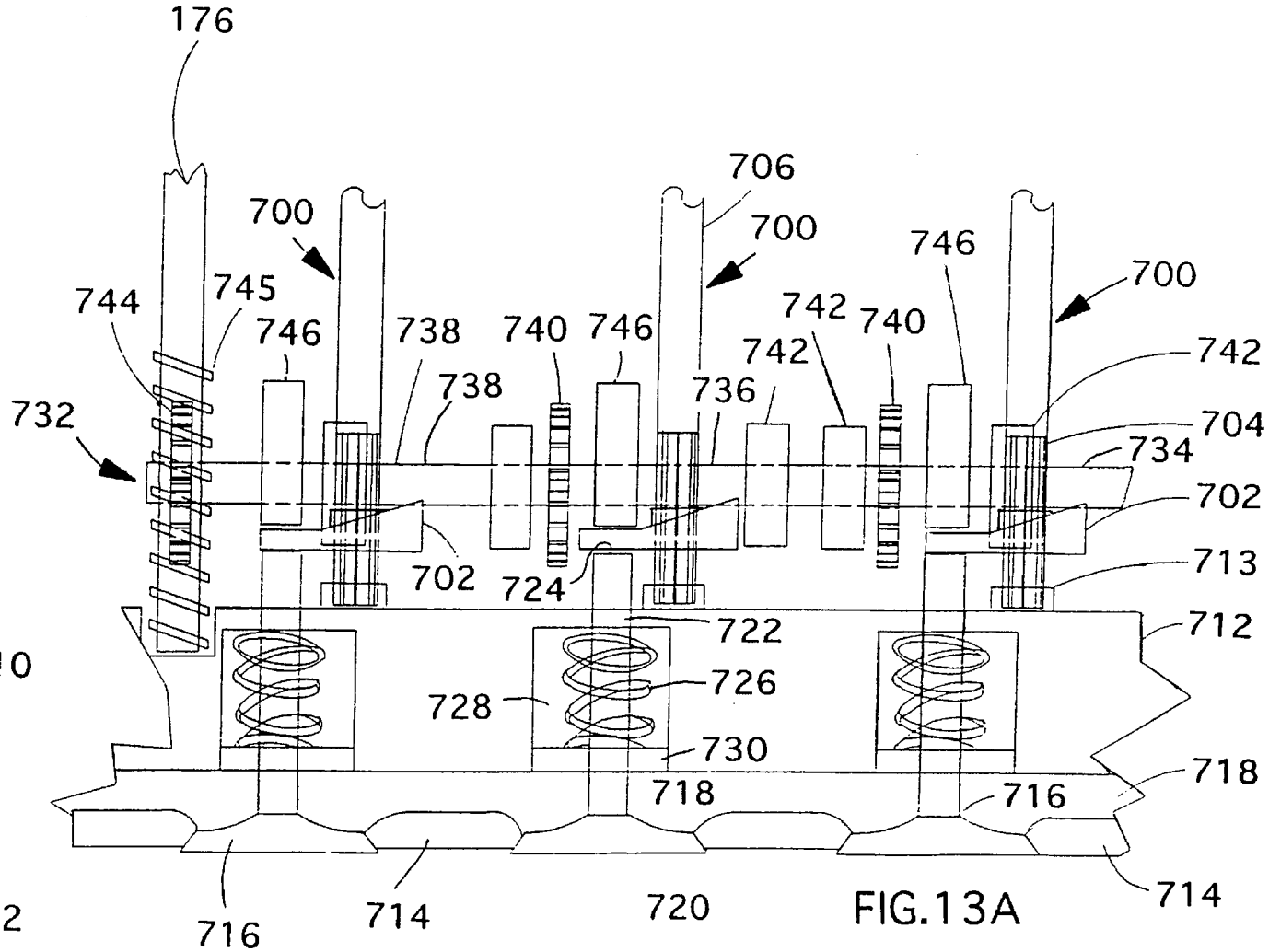
FIG. 13A shows a diagrammatic view of the poppet valve and tapered washer assembly as an alternative to the rotary disk assembly, with the poppet valve and tapered washer assembly on a cylinder head-manifold assembly or block.
Figure 13B:
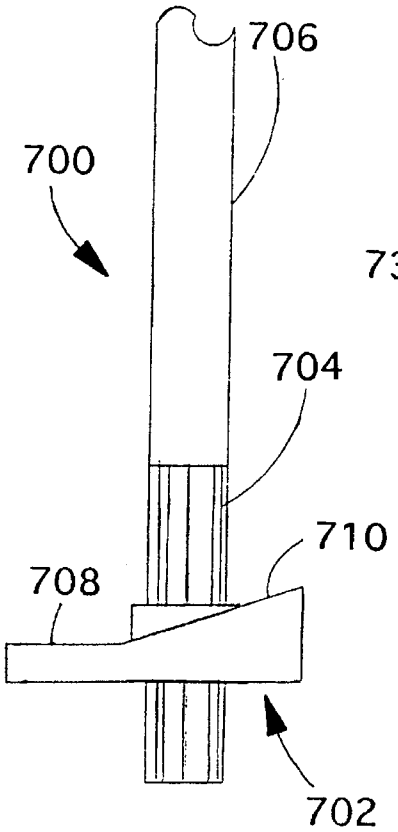
FIG. 13B shows an isolated view of the poppet valve assembly.
Figure 13C:
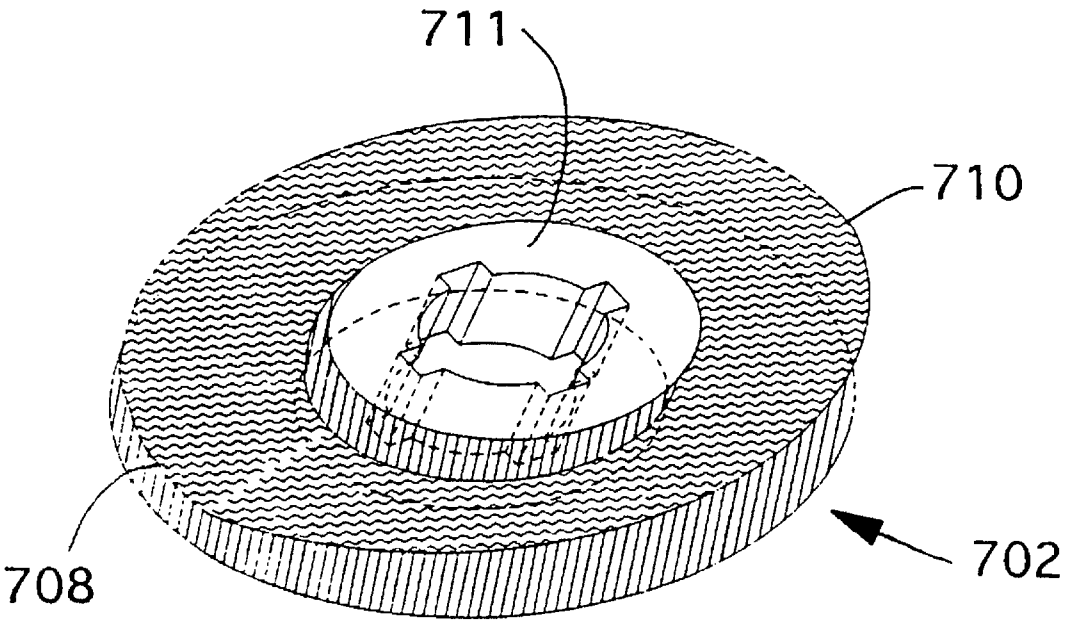
FIG. 13C shows an isolated perspective view of the tapered washer.

Block and head arrangement 11 includes interconnecting end plates 422 on one end of the engine 10. Interconnecting end plates 422 are shown in FIGS. 10C and 12. End plate 422 includes four pairs of openings 424, 426, 428, and 430 for bolts 74. Each pair 424, 426, 428, or 430 is connected to a different cylinder flange 72 such that four cylinders 12 are disposed in a diamond or square arrangement with the cylinders 12 being parallel to each other.

It should be noted that in the other end of engine 10, block and head arrangement 11 includes a single manifold plate 432 interconnecting cylinders 12. Single manifold plate 432 is shown in FIG. 10A and two interconnected manifold plates 432 are shown in FIG. 10B. Manifold plate 432 includes a plurality of openings 434 for power output shaft 18. Each opening 434 includes an annular recession 436 for tapered bearing 242. Manifold plate 432 further includes a plurality of apertures 438 for head bolts 74. Manifold plate 432 further includes, about each of openings 434 and within each circular set of apertures 438, opening 440 for control shaft 142 for effective compression stroke variator plate 120, opening 442 for rotary valve control shaft 176, and opening 444 for control shaft 156 for compression release plate 146. As shown in FIG. 10B and 10D, it should be noted that one-half of an end plate 445 may be used to interconnect manifold plates 432.

Manifold plate 432 functions to interconnect four cylinders just outward from manifold 78 and their respective cylinders through bolts 74 and associated lock nuts and spacers. Manifold plate 432 is positioned and functions as manifold plate 80 would and also functions to stabilize its end of engine 10 to keep oil in. Manifold plate 432 also functions to keep oil from leaking out of the bottom of the end covers 448. In effect manifold plate 432 has replaced manifold plate 80 with the additional task of interconnecting four cylinder assemblies.

11. Engine adjustment control shaft isolation

Figure 11B:
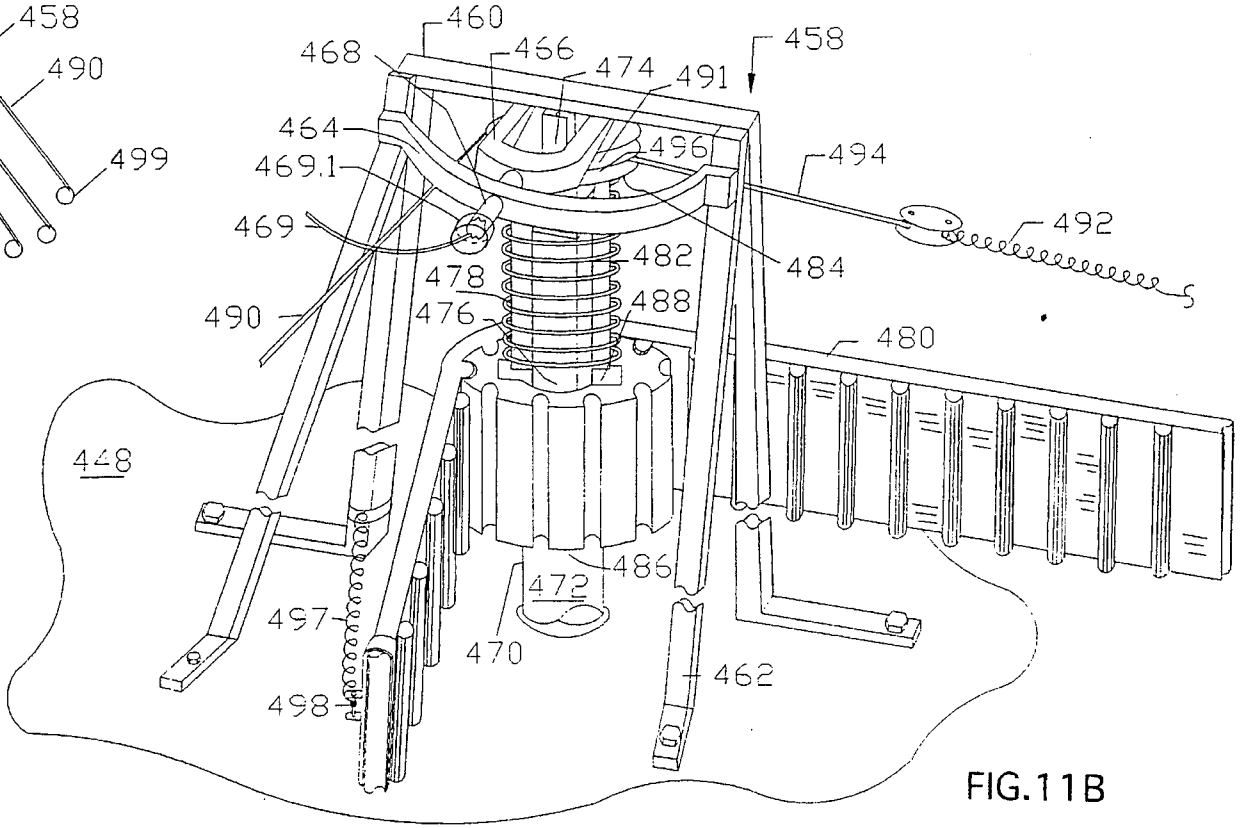
FIG. 11B shows one of the single cylinder operation isolator mechanisms mounted on the exterior of the motor. (Duplicate mechanisms are used for the effective compression stroke variator plate, timing, compression release and throttle control.)
Figure 11A:
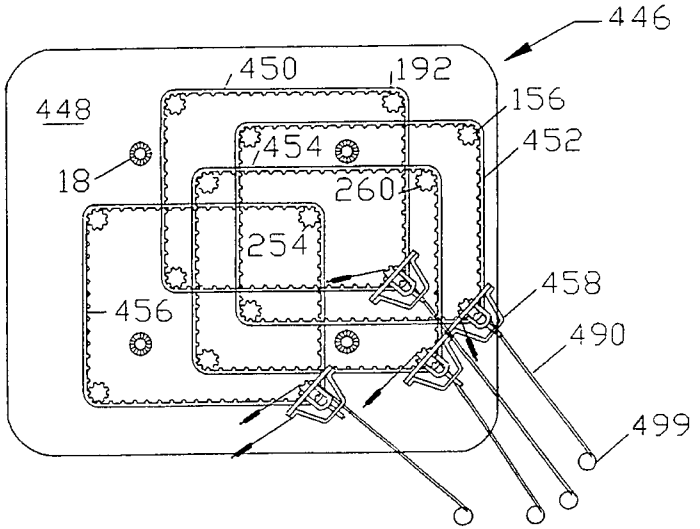
FIG. 11A shows an end view of linkage synchronizing for a four cylinder motor for throttle, timing, compression release and effective compression stroke variation.

FIGS. 11A–B shows a control shaft synchronization assembly 446 on an end cover 448. Assembly 446 and end cover 448 may be used on both ends of engine 10. End cover 448 is shown in FIGS. 11A and 12 and synchronization assembly 446 is shown in FIG. 11A. As shown in FIG. 12, head bolts 74 are utilized to mount end cover 448 to block and head arrangement 11. As shown in FIGS. 11A–B, a belt 450 interconnects all four of control shafts 142 for synchronization of all of the effective compression stroke variator plates 120. Likewise, a belt 452 connects for synchronization all four control shafts 156 for control of all four compression release plates 146; a belt 454 connects for synchronization all four timing control shafts 260; and a belt 456 connects all four throttle control shafts 254.

Each set of four control shafts includes one shaft which may be isolated relative the other three shafts of its set by an isolation assembly 458 shown schematically in FIG. 11A and in detail in FIG. 11B. Isolation of one shaft permits three of the cylinders 12 to cease power production while one cylinder 12 keeps running to generate power for small appliances such as air conditioners, television sets, etc. The isolation assembly 458 includes an end stop housing 460 with legs 462 connected to end covers 448 and 82. Housing 460 includes a curved portion 464 mounting a wedge 466 slideable in an aperture 468 in portion 464. A cable 469 affixed to wedge 466 slides in a sheath 469.1 for pulling and pushing wedge 466 out of and into engagement.

Control shaft portion 470 (a portion of control shaft 142, 156, 254, or 260) includes a lower or inner cylindrical shaft section 472 integrally formed with an upper or outer shaft section 474 square in cross section. A lock 476 with wings 478 slides on section 474. Lock 476 has a bore square in cross section to mate closely with section 474. Rotation of lock 476 drives belt portion 480 (a portion of one of belts 450, 452, 454, or 456). A coil spring 482 is located between an upper portion 484 of lock 476 and the upper surface of shaft to belt connector 486. Wedge 466 is wedged between the upper portion 484 and end stop housing 460 to normally force the engagement of wings 478 of lock 476 with grooves 488 formed in shaft to belt connector 486. Such an engagement causes shaft portion 470 to be engaged with the other control shafts connected to the belt and causes synchronization of all four control shafts. When wedge 466 is slid into a less engaged position between housing 460 and lock 476 such as by a pulling force applied to cable 469, spring 482 pushes wings 478 out of grooves 488 to permit rotation of shaft portion 470 independent of connector 486 and hence independent of belt portion 480. Rotation of shaft portion 470 in one direction is caused by pulling on cable 490 which is connected to pulley 491. Rotation of shaft portion 470 in the other direction of rotation is caused by decreasing the tension on cable 490 which in turn permits coil spring 492 and its cable 494, wound about pulley 496, to rotate shaft portion 470 in such other direction.

It should further be noted that wedge 466 is normally biased into a more engaged position between housing 460 and lock 476 such that lock 476 is normally biased into engagement with connector 486 such that in normal operation all four control shafts are synchronized. In other words, pulling on cable 490 to rotate shaft portion 470 (or decreasing tension on cable 490 to permit spring 492 and cable 494 to rotate the shaft portion 470 in the other direction) normally rotates each of the shafts of one set in unison such that operation of timing, the throttle, the compression release plate 146, or the effective compression stroke variator plate 120 is synchronized. When it is desired to control just one control shaft of each set, then wedge 466 is pulled into a less engaged position such that the control shaft can be rotated to the exclusion of the other three control shafts of its set.

It should be noted that belt return spring 497 mounted between housing 460 and belt connector 498 (slideable on belt portion 480 of belt 450, 452, 454, or 456) adjusts the belt 480 when wedge 466 is engaged or disengaged thus maintaining synchronization.

Each of the effective stroke variator plate control shaft 142, compression stroke plate control shaft 156, throttle control shaft 254, and timing control shaft 269 extends from end plate 448, as seen in FIG. 11A. Located at the external end of one of each group of four shafts 142, 156, 254, and 260 is linkage or synchronization assembly 446 which includes belts 450, 452, 454, and 456. The linkage assembly 446 further includes an isolation assembly 458, shown in FIG. 11B which includes activating and deactivating wedge 466 which functions to engage or disengage the single cylinder operation capability. End stop housing 460 functions to stabilize wedge 466 and linkage assembly 446 including its belts 450, 452, 454, and 456. Wedge 466 is located between a two grooved pull disk having two grooves or pulleys 491 and 496 and housing 460. The two grooved pull disk receives input through cable 490 in one groove 491 to turn one of the control shafts which through its respective belt turns the other respective control shafts. Return cable 494 is connected to the other groove 496 and is attached to return spring 492 which functions to automatically return the driven or rotated shaft 470 to the stop position. Cable 490 is connected to rotating member or shaft and pulley combination 499 which is connected to a standard throttle linkage. This arrangement works equally well for the compression release, effective compression stroke variation, throttle and timing. Spring 482 functions to disengage the linkage assembly for single cylinder operation. Pull disk locking protrusions 478 engage grooves 488 located in belt interconnector 486 which functions to interlock the driven shaft to the driving shafts. Toothed belts 450, 452, 454, and 456 interconnects similar functioning shafts to synchronize their operations with the rest of engine 10. Belt-to-return-spring-connector 498 functions to connect belt 450, 452, 454, or 456 to return spring 497 to keep the control shafts synchronized enabling proper reengagement to multiple cylinder operation. End stop housing 460 is bolted to end cover 448 and 82.

12. Power transfer shaft

As shown in FIGS. 1 and 4A–B, a power transfer shalt 502 has gears on both ends and extends from one end of engine 10 to the other end of engine 10 outside and parallel to cylinder 12 and functions to transfer power from one rotary valve control shaft 176 to the rotary valve control shaft of the other end of engine 10, as reduction gear drive 362 is disposed typically on only one end of power take off shaft 18. The power transfer shaft 502 thus also transfers rotational power to the fuel pump cam disk 268 of the other end of engine 10.

13. Operation

The general operation of the present engine is provided by the piston 16 which shuttles as far as possible in the cylinder 12 during the power stroke until the temperature of the exhaust is at the desired temperature or pressure, preferably ambient temperature or pressure. This maximizing of the length of the power stroke is provided by opening port 104 during a portion of the compression stroke to expel some of the intake air and then closing port 104 to provide for an effective compression stroke. Accordingly, the relative lengths of the power and compression strokes may be varied. Further, it should be noted that the flywheel 413 may be utilized to continue drive piston 16 in the axial direction past the point where the heat of combustion does not include sufficient energy to continue to push piston 16. For example, with a conventional internal combustion engine, the temperature at fluid explosion is about 2000° F. and the temperature at the end of the conventional power stroke is above 900° F. With the present engine 10, the temperature at fluid explosion is about 2000° F., and the temperature at the end of the power stroke is preferably below 900° F., more preferably below 700° F., yet more preferably below 500° F., still more preferably below 300° F., and most preferably ambient temperature, such as preferably between 40° F. and 100° F. It should be noted that driving force of the fluid explosion as the temperature in cylinder 12 falls from about 1000° F. to ambient temperature may be progressively weakened, with little driving force being available as the temperature in cylinder 12 reaches below 200° F. At about such a point, the inertia in flywheel 413 drives piston 16 to further expand the volume in cylinder 12. Such volume expansion cools the exhaust temperature to ambient temperature or to the desired temperature by the end of the power stroke. Such results in an engine which runs cooler and which is relatively quiet. With relatively cool gases exiting the engine 10, no muffler is required except during operation of the "jake brake."

It should, be noted that the means for continuing to drive the piston past a point where energy from the fluid explosion alone is unable to drive the piston along the axis includes the inertia of the piston in the axial direction and the inertia of the piston in the radial direction, the rotational inertia of the shalt, and the flywheel. It should be noted that even though the flywheel 413 continues to drive piston 16 past the point where the energy from the fluid explosion can no longer alone drive piston 16 axially, the energy from the fluid explosion still aids in driving piston 16 somewhat since the energy of the fluid explosion contains some potential energy. Accordingly, the flywheel 413 uses less energy to drive or draw piston 16, and hence has more rotational energy available for driving piston 16 through the compression stroke. The driving force of the fluid explosion provides substantially all of the driving force at the time of ignition. Such driving force is then reduced by friction including friction caused by track and rider arrangement 22, piston crown 20 and other piston rings on the cylinder wall, the compression building for the next power stroke, the load on the flywheel, and other friction such as with any bearing and spline arrangement. At some point in time, the driving force of the fluid explosion equals the forces acting against such expansion, which forces are the means for continuing to drive the piston past a point where energy from the fluid explosion alone no longer is able to drive the piston along the axis, which forces include the inertia of the piston in the axial direction and the inertia of the piston in the rotational direction, the rotational inertia of the shaft, and the flywheel.

Specifically, the starter 512 is operated to turn flywheel 413, which in turn rotates power output shaft 18. Power output shaft 18 then cycles piston 16, i.e., begins to spin and shuttle piston 16 in cylinder 12 almost simultaneously by virtue of track and rider arrangement 22. Power output shaft 18 further begins to rotate reduction gear train 364 which in turn rotates gear 370 which in turn rotates drive or control or power input shaft 176 which yet in turn rotates both fuel pump cam disk 268 (through gear 271 on shaft 176) and rotary valve 77 (through gear 180.1 on shaft 176). Fuel pump cam disk 268 then operates fuel pump 280 which injects fuel into cylinder 12 at the cylinder head 76 through fuel pump injector 343 at the time that port opening 183 of rotary valve 77 is located over normally closed power port 96. At such, time, piston crown 20 is at or near the top or beginning of the power stroke. The fuel injected is then ignited if the compressed air is sufficiently hot.

At ignition, piston 16 is driven to shuttle or reciprocate in cylinder 12. As piston 16 shuttles, track and rider arrangement 22 spins piston 16, thereby spinning power output shaft 18 to provide rotational power. The length of axial travel of piston 16 in cylinder 12 during the power stroke is predefined such that at the end of the power stroke, the exhaust is at a relatively low pressure or temperature, such as at ambient pressure or temperature. The length of the power stroke is typically of significantly greater length than the conventional automobile power stroke. As shown in FIGS. 1B, 12, 14, and 16A–C, this long power stroke is provided for by a substantially oversquare relationship between piston stroke and piston diameter. Accordingly, piston 16 is shuttled from end to end and piston 16 is forced to rotate to thereby rotate power output shaft 18. Providing piston rods and a crankshaft for piston 16 is not preferred, although such may be accomplished, because of relatively greater length that piston 16 travels before the heat of combustion or energy of the fluid explosion alone is no longer able to drive piston 16.

After flywheel 413 has drawn piston 16 to expand the effective volume of cylinder 12 to cool the exhaust gases to the desired temperature, piston 16 then begins the exhaust stroke, at which time port opening 183 of rotary valve 77 is located over exhaust port 100 of the cylinder head and manifold exhaust port 212 (which communicates with manifold opening 228).

At the completion of the exhaust stroke, piston 16 then begins the intake stroke, which draws air inward through manifold opening 224, manifold port 202, rotary valve port opening 183, and cylinder head port opening 96. During this stroke, rotary valve 77 is rotating such that its port opening 183 is in a rotating and communicating position between manifold port 202 and cylinder head port opening 96).

At the completion of the intake stroke, piston 16 then begins the compression stroke, which initially expels air outwardly through cylinder head port 104, rotary valve port opening 183, and manifold port 208 (which communicates with manifold outlet 228). During this stroke, rotary valve 77 is rotating such that its port opening 183 is in a rotating and communicating position between cylinder head port 104 and manifold port 208. At some time during the compression stroke, port opening 183 travels past the end of port 104 (such end is defined by end 122 of compression stroke variator plate 120) such that pressure begins to build in the cylinder 12. Such is defined as the effective compression stroke. Accordingly, the length of the effective compression stroke is shorter than the power stroke. It should be noted that the compression pressure caused by the effective compression stroke may be if desired about the same as the pressure in a conventional internal combustion engine having piston rods and a crankshaft. It is preferred that the effective compression stroke is less than the length of the power stroke. Further, it should be noted that if, in the present engine, the compression stroke is the same length as the power stroke, the heat of combustion or all of the energy of the fluid explosion may not be utilized fully.

At the completion of the effective compression stroke, the cycle begins anew, as mentioned above.

If it is desired to use the engine 10 as a "jake brake", compression release plate 146 is opened to open cylinder head ports 114 and manifold port 210 and effective stroke variator plate 120 is operated to fully close port 104. Accordingly, intake air is fully compressed during the compression stroke to create the requisite drag between piston 16 and power output shall 18 and such compression then released out cylinder head ports 114, manifold port 210, and manifold inlet 228 before fuel is injected or ignited or shut off.

Figures 16A, 16B, 16C:
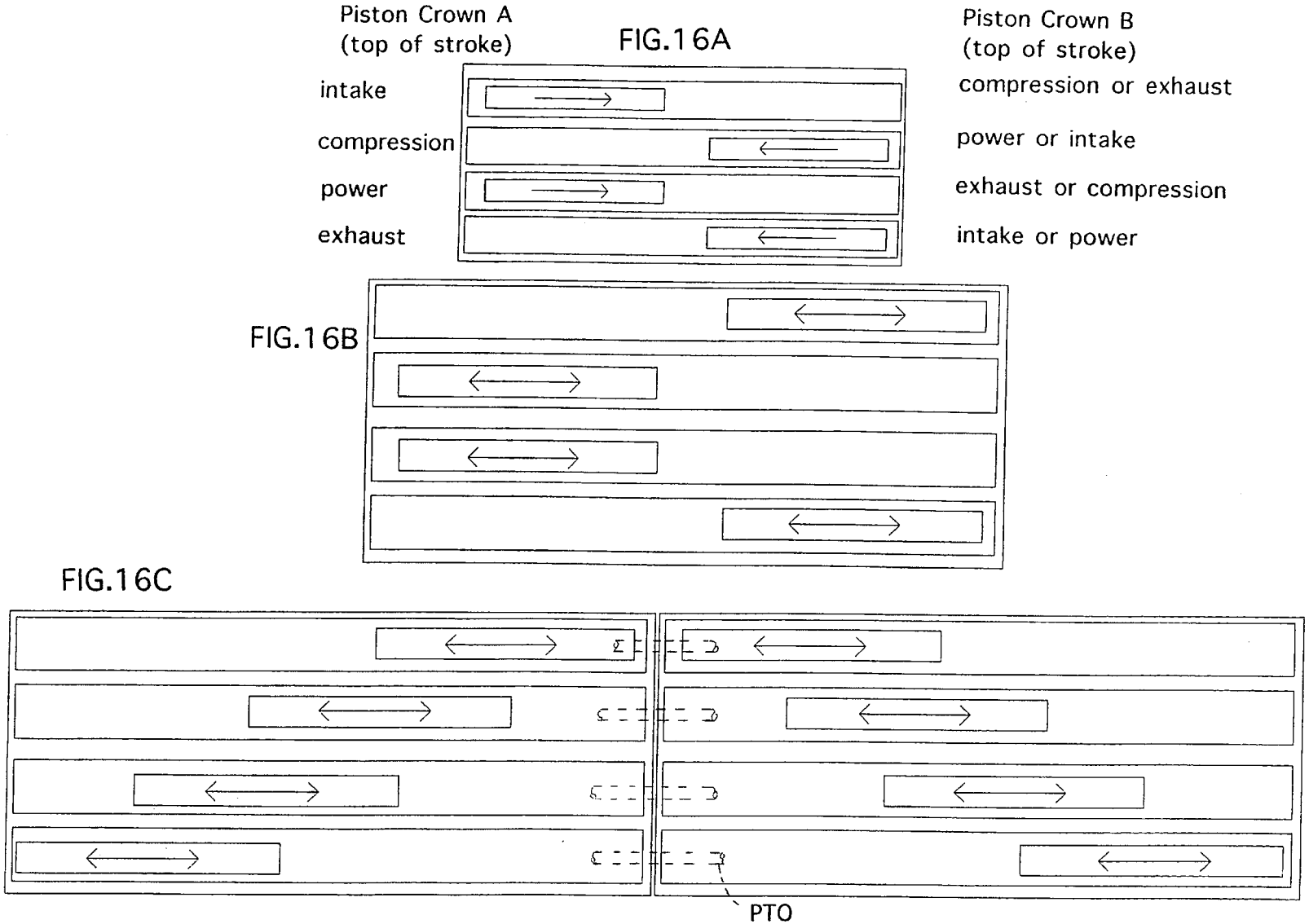
FIG. 16A shows a schematic view of a combustion cycle for a piston with two piston crowns.
FIG. 16B shows a schematic view of a timing sequence of four pistons disposed in a plane wherein the outer two pistons are paired by motion and the inner two pistons are paired by motion.
FIG. 16C shows a schematic view of a timing sequence for two sets of four pistons in a plane wherein the sets are placed end to end and wherein each piston of one set is paired with a single piston of the other set by equal and opposite motion and wherein each piston is staggered equally from its adjacent piston or pistons at one point in the cycle and wherein the pistons of each set as a whole traverse the length of the module at one point in the cycle.

Engine 10 preferably includes piston 16 with two piston crowns 20 and two head portions such that the piston 16 is driven in both axial directions. As shown in FIG. 16A and in the following column, piston cycling in such an arrangement is such that as one piston crown A is at the start of its intake stroke, the other piston crown B of the same piston 16 is either at the start of its compression stroke or exhaust stroke. When piston crown A is at the start of its compression stroke, piston crown B is at the start of its power or intake stroke. When piston crown A is at the start of its power stroke, piston crown B is at the start of its exhaust or compression stroke. When piston crown A is at the start of its exhaust stroke, piston crown B is at the start of its intake or power stroke.

TABLE 1

| Piston Stroke | Piston Crown A (start of stroke) | Piston Crown B (start of stroke) | Piston Crown B (start of stroke) |
|---|---|---|---|
| 1 | intake | compression | exhaust |
| 2 | compression | power | intake |
| 3 | power | exhaust | compression |
| 4 | exhaust | intake | power |

Figure 14:
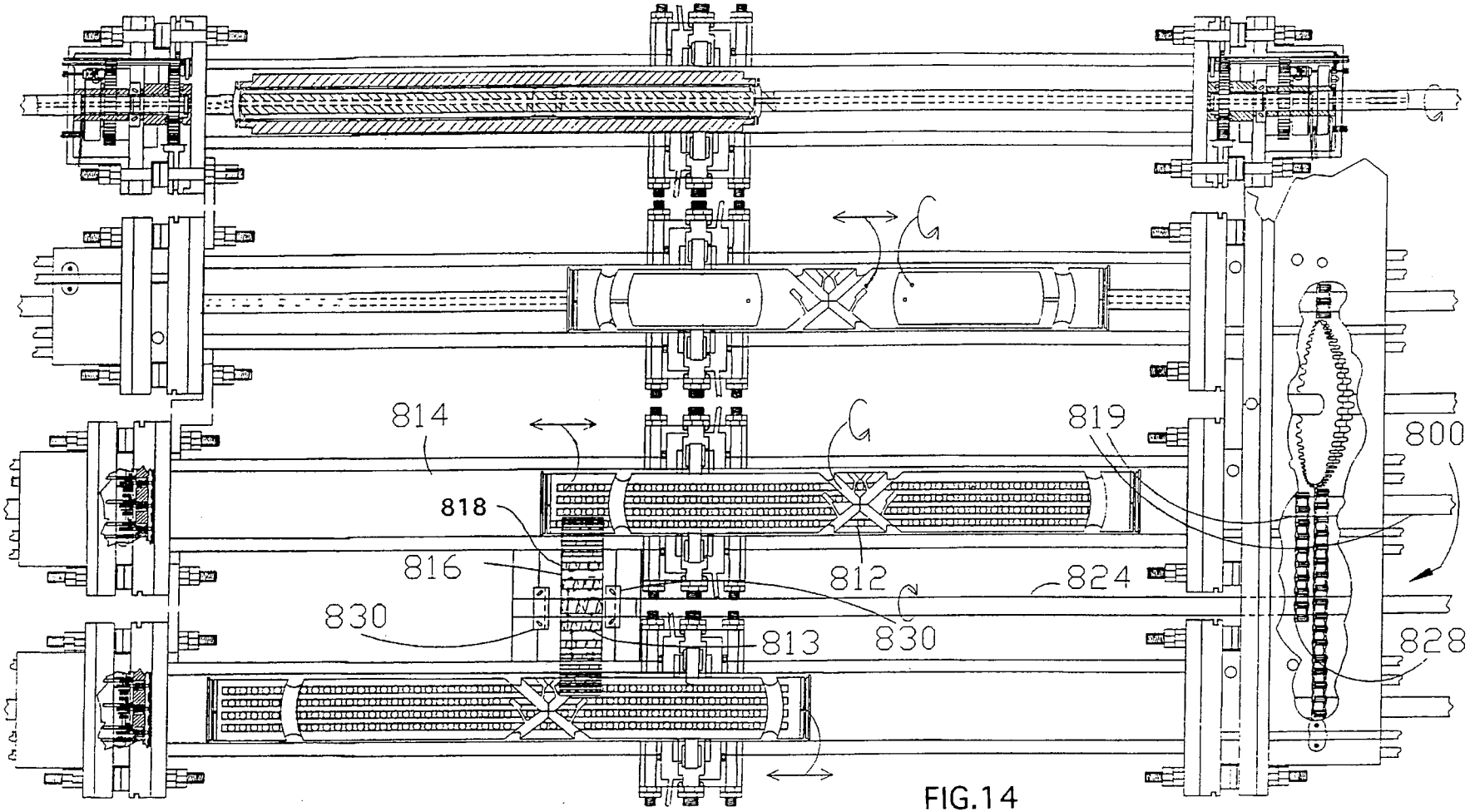
FIG. 14 shows a diagrammatic view of an alternate assembly for driving the power output shaft wherein the alternate assembly includes a splined piston having roller bearings in the splines.

Accordingly, since one unit or module (defined as one piston 16 with two piston crowns 20 and two head portions, as shown in FIG. 1B) fires twice over two consecutive strokes and then is "silent" for two consecutive strokes, it is more preferred that the present engine 10 includes at least two unit or modules such that the engine 10 is firing consecutively and continuously driving a common power output shaft. With such a two module arrangement, the modules are laid end to end and in line to minimize vibration. Here, the pistons 16 may be axially on the same power output shaft 18 or the pistons 16 may be driving a drive shaft as shown in FIG. 14.

Still more preferred is four modules for engine 10. The inclusion of four modules permits two of the modules to be paired by motion and the other two modules to be paired by motion. Such minimizes vibration by each of the modules canceling out the vibration of the other module pairings.

For example, with a block and head arrangement of the engine 10 may include a first unit which includes at least four pistons 16 in respective four cylinders 12 with respective four axes, with the axes being parallel, with each of the cylinders 12 having opposite first and second cylinder heads 76, with each of the first cylinder heads lying in a first plane and with each of the second cylinder heads 76 lying in a second plane, with the first and second cylinder heads 76 being anchored on respective opposite sides of the block and head arrangement, with each of the piston strokes having a common length, with two of the pistons 16 being paired by motion and with the other pair of pistons 16 being paired by motion, and with one pair of pistons shuttling in the opposite axial direction from the other pair of pistons 16. Still further, two of these axes may lie in a third plane and the other two axes may lie in a fourth plane, with the third and fourth planes lying at right angles to and intersecting each other, with the axes which lie in the third plane having one pair of pistons 16 paired by motion and with the axes lying in the fourth plane having the other pair of pistons 16 paired by motion, with the axes being circumferentially spaced equidistant from each other.

The following Table 2 shows the timing cycle for the four module block and head arrangement, where I stands for the start of the power stroke, C for the start of the compression stroke, P for the start of the power stroke, and E for the start of the exhaust stroke. Side A stands for one common side of the module arrangement where all cylinder heads 76 of Side A lie in a common plane and Side B stands for the other common side of the module arrangement having opposing cylinder heads 76:

TABLE 2

| Piston Stroke | | Module 1 | Module 2 | Module 3 | Module 4 |
|---|---|---|---|---|---|
| 1 | Side A | C | I | P | E |
| | Side B | P | E | C | I |
| 2 | Side A | P | C | E | I |
| | Side B | E | I | P | C |
| 3 | Side A | E | P | I | C |
| | Side B | I | C | E | P |
| 4 | Side A | I | E | C | P |
| | Side B | C | P | I | E |

For the timing cycle shown above, it is preferred that the axes of modules 1 and 4 are parallel and in a first plane, and that the axes of modules 2 and 3 are parallel and in a second plane, with the planes at right angles to each other and which the axis placed equidistant from each other. Accordingly, a power stroke will be effectuated in each plane for every stroke.

For the four block arrangement, it should be noted that other geometric possibilities include laying all four axes of each module in the same plane with all four axes parallel. With such, it should be noted that modules 1 and 4 of the above timing cycle of Table 2 would be placed on the outside, with modules 2 and 3 in the inside. Accordingly, the outside modules 1 and 4 are paired by motion and the inner modules 2 and 3 are paired by motion.

Timing of the firing of each cylinder relative to each other, the timing sequence, is simple. In a four module arrangement pistons on the diagonal fire alternately at the same end and traverse their respective cylinders at the same time and direction. The opposite diagonal does the same only it fires at the opposite end on the alternate stroke. This arrangement reduces torquing and vibration of the motor. A second option is to have the same motion but have two pistons fire off the diagonal and at opposite ends every time they are at opposite ends of engine 10. This is accomplished by turning two shafts a suitable number of revolutions before connecting the chain 412. Multiples of more than four cylinders require more than one manifold plate 432 with an exterior groove to accommodate an additional O-ring seal 504 which includes a tongue seal and groove seal meshing between the edges of manifold plates 432, and the accompanying stabilizing plates 442 (seen in FIG. 10B), and a larger end cover 448. Timing of the multiple groups of four has the same options as the single block, but they can be evenly divided between the blocks so as to space the pulsing of ignition as equally as possible before installing the idler sprocket 510, thereby reducing pulsing and increasing smoothness in the motor thereby increasing its durability. Plates 422 interconnect the other end of engine 10 from below cylinder flange 72 with the cylinder head bolts 74 functioning to provide interconnection and rigidity at that end of engine 10.

Use of an oil filter such as off the shelf purifier and or spinner II enhances durability of engine 10 due to their ability to remove moisture and extremely fine particles of contaminants. Their use would have to be intermittent due their ability to remove the additives mentioned below before they had the chance to be properly assimilated by engine 10.

As seen in FIG. 1B, engine 10 includes a starter 512 fixed to block and head arrangement 11 and geared to flywheel 413.

FIG. 16A illustrates the concept of a single piston with two crowns, one on each end, progressing through the combustion cycle. From this drawing, it is noticed that there are two consecutive power strokes separated by the requisite exhaust, intake, and compression strokes.

FIG. 16B illustrates the motion that reduces vibration in an individual unit of four double crowned pistons (four pistons and effectively eight cylinders) due to the fact that the piston motion is counteracted by other piston motion without producing alternating torsional loads on the motor mount.

FIG. 16C illustrates eight double crowned pistons (effectively sixteen cylinders) paired end to end thereby counterbalancing each other with the additional advantage of staggering the ignition pulses or fluid explosions which makes a smoother running engine.

14. Modifications

The part modifications are few and consist of a second port in the rotary valve useful in both the compressor and two cycle versions. The compressor versions have modified manifolds with four chambers and automatic one way valves, no rotary valve cam disk or fuel pump or driving hardware. While the two cycle version has a second cam lobe on the fuel pump cam disk and a second port in the rotary valve, two power take off gears on the cylinder head power transfer shaft to drive the built in place flexible double ported rotary sleeve valves, one on both sides of the rider arrangement 48, with tapered edges to allow smooth conforming with the cylinder walls interior dimensioned to reduce or eliminate oil spilling into the cylinder or snagging the piston rings on the ports or valve. The elliptical grooves in the cylinder wall on both sides of the guide pin mount contain the sleeve valve and reduce sharp flexing to increase its durability. The sleeve valve has notches to mesh with the gear teeth on the power transfer shaft to time its rotation to line up with the cylinder wall ports as the piston passes them. A blower and air chamber is added to provide air to enter the cylinder ports when they are open at pressure to exhaust the combustion gases.

It is possible to mix two and four cycle on the same motor if one desires to reduce vibration due to having an integral compressor for air brakes or other reasons such as air horn, windshield wipers, or power windows.

The poppet valve version modifies the manifold to become part of the cylinder head and to have four or six valves per cylinder head with at least one valve actuated with a tapered rotatable washer mounted on a suitably shaped shaft such as a splined shaft so the adjustment point is isolated from the cam action with the washers tapered radius between a cam lobe and the valve stem. The cam shaft is overhead and split into four or six pieces, connected by gears, for each head and is driven by a worm gear interconnecting one end of two of the cam shafts. The worm gear is on the end of the shaft that also drives the fuel pump cam disk. This arrangement eliminates the rotary valve, compression release plate and the effective compression stroke variator plate and allows for variable effective compression stroke and compression release.

An additional alternative eliminates the shafts through the cylinder head and combustion chamber and piston. This alternative replaces such a shaft with a set of splines on the piston exterior with roller bearings embedded therein and connected to a gear outside the cylinder through an opening. This gear is mounted on a shaft which is centrally located between the pistons and becomes the power output shaft. It is trained to the shaft that is the longitudinal axis of the motor to time all of the functions of the motor as previously mentioned.

FIGS. 13A, 13B, 13C, and 14 show a poppet valve assembly 700 having a tapered washer 702 slideable in the axial direction on a splined shaft portion 704 of a rotatable adjustment shaft 706. Rotation of shaft 706 rotates tapered washer 702. Tapered washer 702 has a relatively thin flat portion 708 and a tapered relatively thick portion 710. Tapered washer 702 includes an integral relatively thick annular portion 711 for stabilizing washer 702 from thrust loads of cam lobe 746 and for providing a bearing surface which slides on splined shaft portion 704.

Poppet valve assembly 700 is engaged with cylinder head-manifold assembly 712 via bushings 713 on the assembly 712. Assembly 712 includes a plurality of valve seats 714 for valve heads or valves 716 which may be intake or exhaust valves. Valve heads 716 open and close fluid chamber 718 relative to cylinder chamber 720. Valves heads 716 are fixed to valve stems 722 which extend through cylinder head-manifold 712. Valve stem 722 includes an upper end 724 for engaging the nontapered face of tapered washer 702. A coil spring 726 surrounds valve stem 722 in an opening or mount 728 of cylinder-manifold assembly 712. Coil spring 726 is held in mount 728 by a retainer 730.

A cam arrangement 732 includes a plurality of staggered cam shafts 734, 736, 738, which are interconnected by gears 740. Bearings 742 support cam shafts 734, 736, 738 relative to cylinder-manifold assembly 712. A gear 744 on cam shaft 738 is turned by a worm gear 745 of drive or control shaft 176. Cam lobes 746 on each cam shaft 734, 736, 738 engage the upper tapered surface of tapered washer 702.1 It should be noted that there are additional cam shafts to operate the valves on the other half of the cylinder head.

Cam lobes 746 normally engage tier portion 708 of washer 702 such that valve heads 716 operate in typical fashion. However, by rotating shaft 706, tapered washer 710 may be rotated so as to bring a portion of the taper of tapered bushing 710 into location between cam lobe 746 and end 724 of valve stem 722. Such displaces valve head 716 from valve seat 714 over a longer distance and for a longer period of time. Accordingly, poppet valve assembly 700 may be used as an alternative for effective compression stroke variator plate 120 and/or compression release plate 146.

The tapered washer 702 shown in FIGS. 13 and 14 is used to easily vary the opening and timing of the poppet valves 716 of choice in order to allow the effective compression stroke to occur or for the compression release to occur or both simultaneously, to allow the motor to run on a single cylinder.

There is a choice of which poppet valve 716, due to the fact the cam lobes 746 do not function to open the valves 7 12 at the same time, thereby necessitating the use of more than one valve in-order-to provide continuous opening of the cylinder 12 to the manifold-cylinder head assembly 712.

However, when just using the compression release function only, one valve needs to be adjusted, or when only operating the effective compression stoke variation only one valve 716 needs to be adjusted. These adjustments are made the same way as in the earlier description for the compression release plate or effective compression stroke variator plate, that is, by rotating a shaft 706 that extends through the end covers 82 and/or 488 and linkage arrangement 458 and 499 that allows the individual block and head arrangements to be coordinated.

The tapered washer 702 is placed between the cam lobe 746 and the poppet valve stem 722 duplicating the function of the more familiar rocker arm and allowing easy opening and timing variation of the chosen valves 716. This is accomplished by moving a thicker portion 708 of the tapered washer 702 between the valve stem 722 and the cam lobe 746. Additionally, as the lobe crosses the thicker portion of the tapered washer it opens the valve further and for a longer period of time.

The tapered washer 702 is mounted on a shall 706 suitably shaped to rotate tapered washer 702 and to allow the tapered washer to slide up and down on the shaft portion 704 to engage the stem 722 as the cam lobe 746 directs. Such shapes include splined, oval, square, triangular or others. This indicates that the tapered washer 702 has a suitably shaped aperture for the shaft.

This motion, as is directed by the cam lobe 746, is usually up and down in a sliding motion on shaft portion 704, thus is not transferred to the shaft 706 as a whole or to the adjustment means for the shaft 706, thereby simplifying the process of adjustment by permitting the shaft 706 to be stationary in the axial direction.

The poppet valve arrangement 700 only changes the structure of the illustrated motor by four localized and modular modifications 1) the removal of the rotary valve 77; 2) the addition of additional shafts 706 to operate the tapered washers 702; 3) the manifold 76 is replaced by the poppet valves assembly 700, cylinder head-manifold 712, and cam shaft arrangement 732; and 4) shaft 176 that drives the rotary valve 77 is modified on the inner end with worm gear 745 to drive the cam shafts 734, 736, and 738. The cam shafts 734, 736, and 738 may be split in order to accommodate the axial shaft 18 of the motor, thereby making four or more cam shafts 734, 736, 738 per cylinder head manifold arrangement 712, with each cam shaft 734, 736, 738 containing one cam lobe 746. The split cam shafts 734, 736, 738 are trained to each other by gears 740 so as to keep the opening timing accurate. Bearings 742 holds camshafts 734, 736, 738 in place while bushings 713 stabilize the tapered washer control shaft 706 in place on the inner end.

Figure 15:
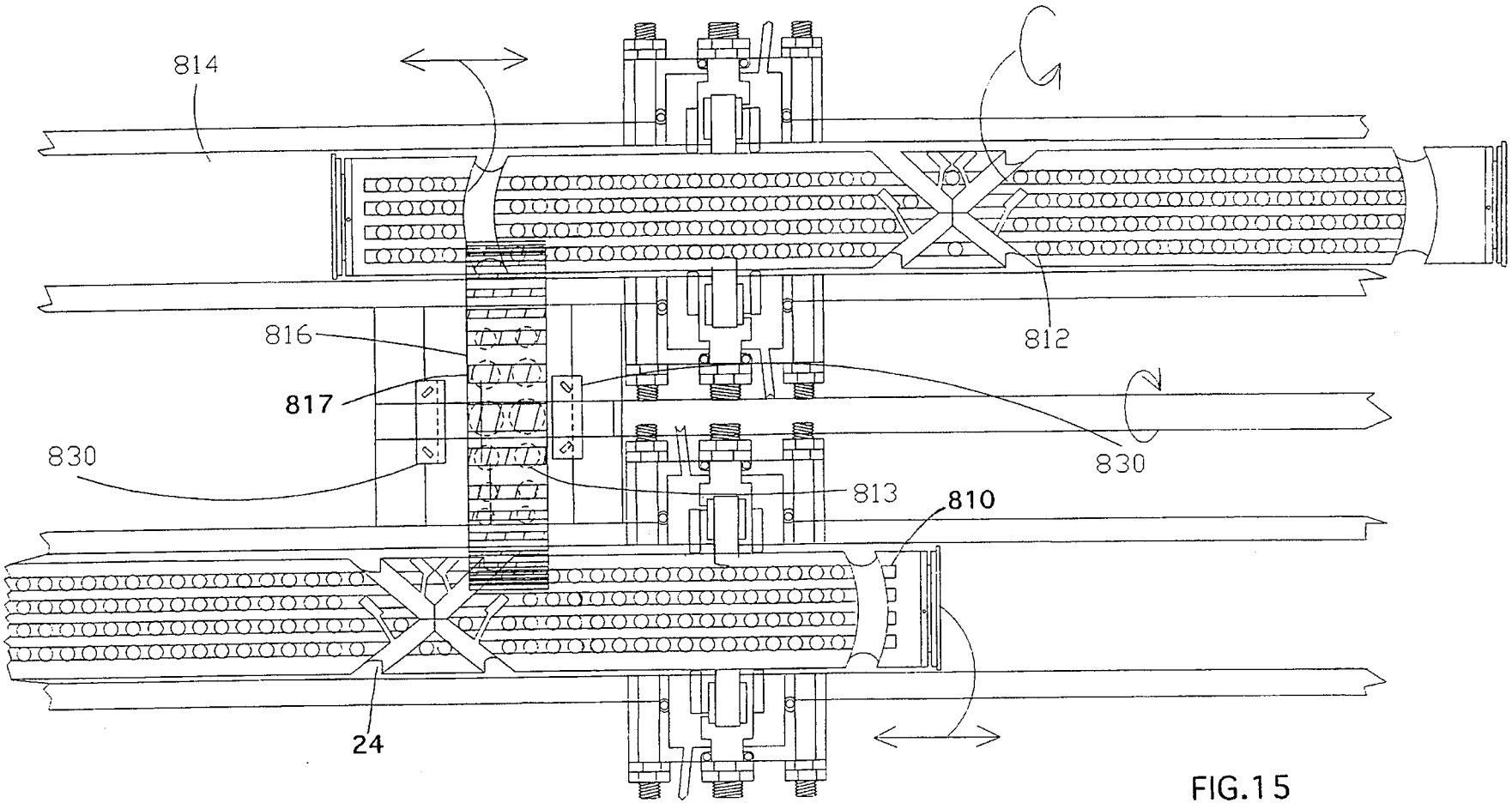
FIG. 15 shows the alternate assembly of FIG. 14 in greater detail.

If there is too much blowby around the axial shaft 18 and axial piston seals 385 to maintain an efficient and durable motor, an alternative means 800 shown in FIG. 13 and FIG. 15 is available to extract the rotary motion of the piston 16, that additionally maintains all of the other qualities of the motor. In fact, the two styles of power extraction may be combined in the same motor, provided there is more than one set of four pistons 16. This further illustrates and expands the modular concept of the motor.

1) The piston 16 is modified on both the interior and exterior. The interior becomes solid, or hollow, to reduce weight.

2) The exterior exchanges the shallow depressions 389 for oil into the splines 810 that extend most of the length of the piston. Also the piston is lengthened such as by including an additional portion 814 to accommodate the power take off gear 816. The additional portion 814 is typically on one end of the piston only and corresponds to the width of gear 816. Gear 816 is of a sufficient width to transverse or contact at least two rollers 812 at the same time and of sufficient width to cross intersections 36. The ring assemblies or piston crowns 20 are excluded from becoming splined. Also the grooves 24 for the guide pins are deeper. This also necessitates longer guide pins 62, 64 and 68.

It should be noted that the splines 810 are modified in a new and novel way which may be useful for many other gears. This modification is the addition of bearings 812. The instant application requires roller bearings 812 imbedded in the splines 810 radiating outwardly like spokes with the flat ends of the rollers contained radially at distances less than the piston and spline combination diameter. In addition, the diameter of the roller bearings 812 are greater than the width of the splines 810 in-order-to allow the power take off gear 816 to reduce wear as the piston shuttles through its teeth 818. The roller bearings 812 have a greater diameter than the width of splines 810 to extend out of the splines because there are loads on both sides of the splines at different times in the combustion cycle and during the use of the motor, such as using the motor as a compression break. (As an alternative to roller bearings 812, ball bearings 813 shown in phantom in FIG. 13 may be located in gear 816 such that each ball bearing 813 has a diameter greater than the width of its respective tooth 817. In such a case, roller bearings are absent from splines 810. In sum, a set of bearings is placed either on gear 816 or piston 802, but preferably not on both.)

Also the piston 16 is lengthened 814 to accommodate the addition of the gear 816 that meshes with the splines 810. This is required due to the fact that the aligners 56 would contact the power output gear 816. This necessitates the lengthening of one end of the cylinder 820 and the power transfer shaft 502 and the modification of the end attachment plate 422 if one combines the two styles of power output in the same motor. There is also the required lengthening of the adjustment linkages 499 and 458. In order to keep oil around the power out put gear 816 and shaft 824, there is a casing 826 shaped like the end mount connecting plates 422 only much thicker to accommodate the gear 816 and the bearings 830 that support the shaft 824 that the power out put gear 816 turns. 0f course there is an aperture in casing 826 to accommodate the shaft 824 and four apertures in casing 826 to allow the power take off gear 816 to mesh with the piston splines 810.

Additionally shaft 824 extends through cylinder head assembly 448 in order to provide a means to drive the axially located replacement shaft 819 for shaft 18. This replacement shaft is utilized the same as shaft 18 was except it need not be a power output shaft. Chain and sprocket assembly 828 is one means to accomplish this object.

In operation, piston 802 (with splines 810 and roller bearings 8 12 having a diameter greater than the width of the splines 810 so that one roller bearing 812 extends beyond each radially extending face of spline 810) is driven in the axial direction roller bearings 812 engage one radially extending face a tooth 817 on gear 816. At the same time that piston 802 is driven axially, track and rider arrangement 22 is forcing piston 802 to spin to as to rotate gear 816.

15. Subtle features and advantages

Now that the construction of the engine according to the teachings of the preferred embodiment of the present invention has been set forth, subtle features and advantages of the preferred construction of the present invention can be appreciated.

The present invention relates to compression ignition piston engines and, more particularly, to effectively variable compression stroke rotating piston, compression ignition and direct injection internal combustion engines utilizing rotary valves and/or poppet valves.

The conventional internal combustion engine has ports in the sides of the cylinder, or a combination of ports and poppet valves.

The means by which this motor accomplishes greater efficiency and therefore reduced pollution is done with a minimal materials usage rate.

This motor does have something in common with the original steam engine used to pump water from mines in England, a shaft as the longitudinal axis of the motor.

Numerous compression ignition piston engines have been provided in the prior art. While these may be suitable for the particular purpose to which they address, they would not be as suitable for the purposes of the present invention.

This two and/or four stroke internal combustion engine features a rotating piston and a variable effective compression stroke. It also can be configured with poppet valves instead of the illustrated rotary valves.

Air is pulled and pushed (dram and exhausted) through the two chamber manifold (intake and exhaust) by the suction and pressure of the piston shuttling in the cylinder in the same way as the more familiar four stroke engines.

The rotary valve located at the top of the cylinder head where poppet valves are normally located replaces the poppet valves and functions as it and its port rotates as the cam shaft functions to time air motion into and out of the engine in time with the piston's motion. This arrangement allows the variable effective compression stroke plate located between the rotary valve and the combustion chamber in the cylinder head to slide over one port in the cylinder head which makes it possible to exhaust air from the cylinder prior to beginning compression. This allows the power stroke to be longer than the compression stroke thereby allowing all of the heat of combustion to be used in producing power instead of out the exhaust as in the more familiar piston engines. This increases thermal efficiency.

Three features contribute to the longer power stroke. First, a longitudinal axis of the motor that is a shaft with torque receiving blades at its center. Second, a long piston with external and internal grooves. The internal grooves are straight and parallel to transfer torque to the shaft blades therefore to the shaft which is the power take off device, while the external crisscrossing grooves are used to cause the piston rotate in one direction only due to the guide pins fitting into the external groove from the cylinder walls. Third, a means to insure smooth crossing of the external grooves intersections consisting of additional short grooves which cause an additional guide pin to pop into and out of the crisscrossing external groove thus positioning a fifth and sixth guide pin in the external groove as the central guide pin (there is one central guide pin on each side of the piston to evenly support the pistons pressure to prevent binding on the shaft or in the cylinder) crosses the intersections of the groove. There is an intersection aligner that keeps each set of three guide pins in a straight line. This part is simply a piece of resilient material such as spring steel with three holes for the guide pins. The aligner flexes as the pistons external groove passes underneath it due to the effect of the curvature of the piston as the aligner changes over a 90° arc 45° to either side of the perpendicular to the longitudinal axis of the piston. The aligner also has a protrusion to keep the trading guide pin actuator aligned with the aligner. This actuator also is attached to the trailing guide pin and actuates the trifling guide pin to enter and exit the piston external groove via the previously mentioned short grooves. There is a spring located between the guide pin mount and the actuator that forces the actuator and trailing guide pin into the piston external groove whenever the actuator passes over the short grooves which of course are positioned accordingly. The guide pin mount covers an aperture in the cylinder wall, one edge of which keeps the trailing guide pin actuator from binding the trailing guide pin as the aligner oscillates back and forth and in and out with the guide pin also moving in and out. The guide pin mount has a curved guiding surface for the leading guide pin to be properly seated in the piston external groove. The trailing guide pin could also be electronically actuated and may include an additional set as the piston travels in the other direction.

The plate arrangement over the cylinder head ports also allows a second plate over the compression release port to become an effective compression release that can function two ways. First, as a compression release, it can be used to ease starting and allow running on one cylinder for more efficient idling to provide power for lights, heaters, or air conditioners or other amenities that the manufacturers or operators install. Second, it can be used as a compression release for an engine compression brake which saves brakes and increases safety during prolonged braking down hills to keep brakes from overheating, catching fire or fading. This second use does require a simultaneous use of the variable effective compression stroke plate in the fully closed position. If the variable effective compression stroke is partially open the compression brake effectiveness is reduced which may be desirable for less steep hills.

The injection of fuel that causes the combustion in the cylinder is through a standard fuel pressure actuated injector. The pressurization of the fuel is accomplished slightly differently by a cam disk that actuates a ramp pivoted on one end that has a fuel pump consisting of a piston and cylinder and two one way valves that can, in mass, move along the ramp thereby varying the amount of fuel and power available per combustion cycle. There is an additional attachment to the pump assembly to allow the timing of the fuel injection to not effect the fuel volume per stroke. It consists of a suitably shaped shaft such as a splined shaft passing through a ring that can rotate from the stationary external input of rotary motion of a worm gear in a housing that houses all three parts. One end of the suitably shaped shaft such as a splined shaft is part of the flexible and constant velocity joint, such as a u-joint, that connects to the other part of the flexible and constant velocity joint, such as a u-joint, on the threaded shaft that threads through a housing and extension that houses the fuel injector pump. The housing also stabilizes the ramp. The threaded shaft connects to the cylinder casing through a washer that is also connected to the cylinder casing. As the threaded shaft rotates the cylinder casing moves along the ramp. As the timing changes the suitably shaped shaft such as a splined shaft slides through the ring and the worm gear housing allowing the fuel stroke to remain unchanged until there is an input to the worm gear. The flexible and constant velocity joint, such as a u-joint, allows the unit to flex as the timing causes the fuel pump to travel in an arc around the main shaft that is also the longitudinal axis of the cylinder.

This total arrangement for directing air and fuel through the motor is located at both ends of the combustion cylinders. This total arrangement of piston and cylinder can be duplicated in groups of four in order to allow timing of combustion that reduces vibration.

These groups of four pistons are interconnected by plates connected to the head bolts at both ends of the combustion cylinders and chains under the enlarged (oil pump end), end cover (the oil pump is on one end only). These groups of four pistons can be connected to other groups of four pistons by a larger (oil pump end) end cover and connector plates and an idler gear between the chains connecting the shafts. This allows further vibration reduction due to combustion timing being spread to more times during the time it takes get the number one cylinder to fire the next time.

This overall arrangement can also be changed from square groups of four to other shapes as are required by different applications due to space allowances.

Accordingly, the instant invention will be described in its simplest form, single cylinder single head design. The next complexity level is simply the mirrored image of the cylinder head installed on the other end of the cylinder, and interconnected with the other end with an additional external shaft. The third level of complexity is the grouping of several cylinders in various orientations such as block, diamond or flat, or other, interconnected with plates at one end connected to the head bolts, and a single manifold cover plate and an end cover at the other end, also connected to the head bolts at that end, and a chain inside the end cover to interconnect the main power take off shafts which used to be called crank shafts in the present day motors. These multiple cylinder arrangements have adapters on the motor's control mechanisms to allow single cylinder operation and unified control of the group. The fourth level of complexity interconnects these groups of several cylinders with a larger end cover, interconnecting plates and gaskets, and an idler sprocket. The shaft of the idler can become the power take off point of the motor or one of the other shafts can become the main power takeoff point. As many of these blocks of four cylinders as are required can be grouped together. This feature even allows greater efficiency in the manufacture of the motor, because only the end cover, number of idler sprockets, number of interconnecting plates, number of chains and the number of control linkages change. The other end is interconnected with the same kind of plates mentioned previously, also to the head bolts, just more of them.

Accordingly, the present invention has few parts many of which are usable on both ends of the cylinder. Additionally each piston serves two combustion chambers.

The physics of thermal efficiency of internal combustion engines is based on the fact that expansion of gases in a chamber (cylinder) removes heat. This work is maximized by expanding the chamber until ambient or inlet temperature is reached. This is accomplished in this motor by a plate that slides over a cylinder head port that functions on the compression stroke only, due to the rotary valve port passing over said cylinder head port. This allows the expansion stroke (power stroke) to be longer than the effective compression stroke, thereby reaching maximum efficiency. This is possible due to a long piston with an external crisscrossing straight groove with arcs connecting them near the ends of the pistons with guide pins (explained in greater detail in the detailed parts description) from the cylinder wall fitting into the external groove forcing the piston to rotate in one direction only, and two parallel grooves along the interior length of the piston surrounding the main shaft that is the longitudinal axis of the motor. Said shaft has, along the exterior longitudinal center, two short blades that fit the pistons interior groove with clearance radially from the shaft, to allow oil to pass as the piston shuttles in the cylinder.

This arrangement also allows expansion below intake temperature, although this reduces efficiency. It can reduce or eliminate the infra-red profile of the motor and thereby minimize the chances of the engine or power plant and its appendages such as trucks, planes and or boats from showing up on a infra-red finder or locator. These versions may also have redundancy with regard to the oil pumps and filters and the reduction gear train used for driving the rotary valve and fuel pump cam disk.

Further, the long expansion stroke reduces the noise of combustion as all of the energy is extracted, thereby eliminating the need of a muffler except when using the engine compression brake.

Additionally, the cool exhaust provides internal cooling of the motor without the use of water, antifreeze, radiators, hoses and other related efficiency robbing hardware and their other environmentally compromising chemicals. Hence finders or locators such as poison detectors that sense or detect the normal small leaks of radiator fluids would be hard pressed to locate the present engine or its appendages except for exhaust fumes which will be present anyway.

To further enhance efficiency and durability roller bearings are located in the shaft blades that roll on the flat and parallel longitudinal grooves of the piston interior.

Seals at both ends of the piston around the shaft separate the combustion chamber gasses from the oil inside the piston.

Blowby, an efficiency robber, is reduced by the use of oil additives, while friction, another efficiency robber, is reduced by oil additives. The blowby that does occur is passed through the oil return lines through an oil and air separator and out the vent.

To enhance efficiency in the combustion zone the piston has piston rings mounted as a combination crown and top piston ting. This reduces the non-combustion zone of the cylinder, the space between the cylinder wall and the top piston ring, where fuel, oil, and particulates, collect and form deposits and burn incompletely, thereby causing pollution and inefficiency.

To further enhance efficiency the present engine has rotary valves in the cylinder heads which removes the effort of opening and closing poppet valves, which may amount to approximately 2,000 pounds per poppet valve per opening. This instant arrangement also allows the effective stroke variator plate, and the compression release plate to function as a"jake break" without poppet valves and their camshaft and related hardware, thereby reducing parts and materials usage, in effect making an engine"jake brake" possible with no additional parts.

The compression release plate is useful in enhancing efficiency by allowing the present engine to be used as a powerful compression break going down hill or stopping. A second use appears when starting the multiple cylinder versions on one-cylinder, it reduces the starting power requirements thereby reducing weight (fewer batteries and smaller starter size) thereby increasing efficiency. It also allows the motor to run on one cylinder to provide electrical power to the vehicle to run the heater, air conditioning, or other amenities as the operator or manufacturer has installed without an additional auxiliary power unit and related hardware.

The manifold is efficient in design because it is for both intake and exhaust, and is composed of two pieces, excluding bushings, bolts, oil flap reed valves and o-ring seals. Its position above the rotary valve forces it to function as the tensioner on the rotary valve to reduce blowby in that area of the motor. The oil additives mentioned previously perform the same functions here, while the spacers on the head bolts regulate the tension. The mirrored image of the manifold functions the same way on the other end of the present engine.

The tapered bearing located in the manifold plate transfers end thrust from the shaft to the rest of the motor, thereby stabilizing the shaft in the motor and utilizing the manifold structurally. Outward from the tapered bearing is a spacer on which the fuel pump cam disk rests. The fuel pump cam disk is used to operate the fuel pump which rests outward from the fuel pump cam disk. In its center is the main shaft.

Outward from the fuel pump is the oil pump, on one end only, functioning to send oil, to lubricate, to cool and to clean the motor. In its center is the main shaft.

On the same one end only outward from the oil pump is the first reduction gear in the reduction gear train that powers the shaft that drives the rotary valve and the fuel pump cam disk.

Outward from the reduction gear train is the chain sprocket for multiple cylinder versions only. Outward from the chain sprocket is the end cover that contains the oil that cleans and lubricates the motor.

An additional chain and sprocket will be found on the splined and roller bearing piston version.

Outside the top of the end cover are the synchronizing linkages used to adjust the timing, throttle effective compression stroke length and the compression release. It is also designed to allow single cylinder operation.

More detail of the location of these parts and others and their function follows in the detailed description of the parts.

A primary object of the present invention is to provide a greater efficiency than is possible in a crankshaft type internal combustion engine.

Another object is to utilize a minimum amount of materials to include efficiency in the manufacture of the motor.

Another object is to provide a basic platform for different engine styles such as two-stroke and four stroke, and two and four stroke in the same block, and to provide a basic platform for a single stage hi-compression air compressor for air or other fluids. It should be noted that for the purposes of the present invention, the intake stroke, the compression stroke, the power stroke, and the exhaust stroke as described herein mean both the two strokes of the two stroke, four cycle engine and the four strokes of the four stroke, four cycle engine.

In general, the present invention provides a rotating piston direct injection engine with variable effective compression stroke with compression release with a longitudinal rotating shaft with centrally located protrusions provided to transfer rotating power from piston internal grooves obtained from the linear motion of the piston due to four cycle combustion process converted to rotary motion due to a plurality of guide pins and their aligners positioned in the piston external groove and through the cylinder wall with said longitudinal shaft axis functioning to power the various means of fuel input and air input to properly cycle air through said motor. Efficiency improvers such as piston crowns engaging the sidewall of the cylinder and variable effective compression stroke plates and ports contribute to the novelty of design. The modularity of each complete cylinder and their grouping in various arrangements depends upon external requirements. A compression release plate is a novel means of acquiring compression release in a piston engine. Rotating vanes of the disk type of the present invention is another efficiency improver compared to the heretofore state of the art. Using exhaust gas for internal cooling is a novel result of this design.

Thus since the invention disclosed herein may be embodied in other specific forms without departing from the spirit or general characteristics thereof; some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. An internal combustion engine for maximizing the effective distance the piston is driven during the power stroke to maximize the cooling of exhaust gases, maximizing the use of power produced by combustion, and maximizing the conversion of linear motion into rotary motion comprising, in combination:

a) a block and head arrangement having at least one cylinder with an end and a cylinder sidewall, with the cylinder having an axis with each direction on the axis defining a piston stroke;

b) a spinning and shuttling cylindrical piston in the cylinder, with the piston having at least a first crown, with the piston further having a piston sidewall being spaced from and in close relationship with the cylinder sidewall, with the piston being shuttleable on the axis in both axial directions and spinnable about the axis in the cylinder, with the piston having intake, compression, power, and exhaust strokes;

c) a cylinder head in the block and head arrangement and rigidly fixed to the end of the cylinder and being substantially in the form of a plate to provide for a compact block and head arrangement, with the cylinder head being exposed to the front disk shaped face of the piston crown, with the cylinder head being in dose relationship with the piston crown during the top of the intake and power strokes to contain explosion of fluid, with the cylinder head further comprising a first port for intake of air during the intake stroke, a second port for exhausting air during at least a portion of the compression stroke for regulating effective compression stroke length, a third port for optionally permitting air to be drawn in during the power stroke, and a fourth port for expelling exhaust during the exhaust stroke, with the ports of the cylinder head being spaced from the axis and offset radially from each other;

d) first and second closure means engaged with the cylinder head for regulating the size of the respective second and third ports in the cylinder head, with the first closure means comprising means for regulating the amount of fluid pushed by the piston out of the second port of the cylinder head during the compression stroke for varying the amount of pressure permitted to build in the cylinder for an effective compression stroke, with the second closure means comprising means for opening and closing the third port such that the third port is normally dosed and such that the third port is opened by the second closure means when the engine is to be used as a brake;

e) a manifold rigidly fixed to the cylinder head opposite of the cylinder, with the manifold being substantially in the form of a plate to further contribute to the compact block and head arrangement, with the manifold comprising an intake section with a first port for permitting fluid flow to the first port of the cylinder head during the intake stroke, a compression section with a second port being openable during at least a portion of the compression stroke for permitting the piston to push fluid from the cylinder during the compression stroke, with the second port being closeable whereupon pressure begins to build in the cylinder for an effective compression stroke, with the second port of the manifold communicable with the second port of the cylinder head, a power section with a third port which is openable during the power stroke and communicable with the third port of the cylinder head, and an exhaust section with a fourth port for permitting fluid flow from the fourth port of the cylinder head during the exhaust stroke, with the ports of the manifold being spaced from the axis and offset radially from each other;

f) a manifold plate on the manifold for sealing the manifold;

g) valve means sandwiched between the manifold and the cylinder head for opening and closing the ports by bringing the first, second, third, and fourth ports of the cylinder head into communication with the respective first, second, third, and fourth ports of the manifold, with the valve means being substantially in the form of a plate to further contribute to the compact block and head arrangement, with the valve means comprising a rotatable structure in close relationship with the piston crown at the top of the intake and power strokes, with the rotatable structure being at least partially exposed to fluid explosion causing the power stroke, with the rotatable structure having a periphery concentric with the axis, with the rotatable structure comprising a port opening, with the port opening communicating with the cylinder and with each of the ports of the cylinder head in turn and the rotatable structure closing off the other ports of the cylinder head when the port opening communicates with one of the ports of the cylinder head, with the port opening being rotatable in sequence from the first port of the cylinder head to the second port of the cylinder head to the third port of the cylinder head to the fourth port of the cylinder head and back to the first port of the cylinder head;

h) a power output shaft rotatably mounted to the block and head arrangement and trained to the spinning and shuttling piston such that both spinning and shuttling of the piston rotates the power output shaft, with the power output shaft being journaled to the manifold plate, with the power output shaft axially extending through the piston;

i) with a fuel explosion in the block and head arrangement driving the piston through a power stroke, with the block and head arrangement further comprising means for continuing to drive the piston past a point where energy from the fluid explosion alone is unable to drive the piston along the axis such that volume of exhaust gas in the cylinder is increased and thereby cooled prior to the piston being operated in an opposite direction for an exhaust stroke; and j) piston spin means for forcing the piston to spin in one direction of rotation about the axis regardless of the axial direction of piston movement such that both spinning of each piston in the one rotation direction and shuttling of the piston drives the power output shaft, the piston spin means being between the piston and the cylinder, with the piston spin means comprising an endless track on the piston, with the endless track criss-crossing itself at least once to form an intersection, and with the track having at least one curved portion, a rider pivotable relative to the cylinder and comprising at least three guide pins for engaging the track, with the pins comprising a leading pin, a medial pin, and a trailing pin engaging the track in such sequence and crossing the intersection in such sequence, with the pins of the cylinder engaging the track in line with each other, and means for engaging the trailing pin with the track prior to the leading pin engaging the intersection to prevent the rider from pivoting as the rider crosses the intersection, with the means for engaging comprising means for disengaging the trailing pin from the track after the medial pin has crossed the intersection to permit the rider to travel on the curved portion of the track.

2. A piston assembly for maximizing the effective distance the piston is driven during the power stroke to maximize the cooling of exhaust gases comprising, in combination:

a) a block and head arrangement having a cylinder with a cylinder sidewall and at least a first cylinder head, with the cylinder having an axis defining a piston stroke;

b) a piston with at least a first crown and being in the cylinder on the axis, with the piston having a piston sidewall in dose relationship with the cylinder sidewall, with the piston reciprocating on the axis in the cylinder and including a power stroke and a compression stroke;

c) a power output shaft trained to the piston such that operation of the piston rotates the power output shaft; and d) with a fuel explosion in the block and head arrangement driving the piston through the power stroke, and with the block and head arrangement further comprising means for continuing to drive the piston past a point where energy from the fuel explosion alone is unable to drive the piston along the axis such that volume of exhaust gas in the cylinder is increased and thereby cooled prior to the piston being operated in an opposite direction for an exhaust stroke to expel exhaust gas from the block and head arrangement, with the means for continuing to drive the piston past the point where energy from the fuel explosion alone is unable to drive the piston comprises means for effectively lengthening the power stroke relative to the compression stroke, with the means for effectively lengthening the power stroke relative to the compression stroke includes a port in the block and head arrangement and means for regulating the port, with the means for regulating the port including means for opening the port for at least a portion of the compression stroke such that air is expelled by the piston out of the block and head arrangement during at least a portion of the compression stroke, and with the means for regulating the port including means for closing the port during at least a portion of the compression stroke such that pressure is permitted to build in the cylinder during at least a portion of the compression stroke such that the power stroke is effectively lengthened relative to the compression stroke, with the means for regulating the port including a rotary valve structure in the block and head arrangement for opening and closing the port.

3. The piston assembly of claim 2 wherein the means for continuing to drive the piston past the point where energy from the fuel explosion alone is unable to drive the piston comprises a flywheel trained to the power output shaft.

4. A valve assembly for providing a variable effective compression stroke for a piston comprising, in combination:

a) a block and head arrangement having a cylinder formed by a cylinder sidewall and at least a first cylinder head, and a piston in the cylinder having intake, compression, power, and exhaust strokes, with the piston having a piston crown, with the block and head arrangement further comprising a manifold having an intake portion and an exhaust portion;

b) with the block and head arrangement comprising an intake port for permitting fluid flow to the cylinder during the intake stroke, an exhaust port for permitting fluid flow from the cylinder during the exhaust stroke, and at least a third port being openable during at least a portion of the compression stroke for permitting the piston to push fluid from the cylinder, with the third port being closeable whereupon pressure begins to build in the cylinder for an effective compression stroke, with the third port communicating with the exhaust port in the exhaust portion of the manifold; and c) valve means in the block and head arrangement for opening and closing the ports, the valve means being in close relationship with the piston crown at the top of the power stroke, with the valve means being at least partially exposed to fluid explosion causing the power stroke, the valve means further comprising means for regulating the amount of fluid pushed by the piston out of the third port during the compression stroke for varying the amount of pressure permitted to build in the cylinder for the effective compression stroke, with the valve means closing the third port and exhaust port when the intake port is open and closing the intake port when the third port and exhaust port are open such that air utilized for varying the amount of pressure permitted to build in the cylinder for the effective compression stroke is drawn in through the intake portion of the manifold and exhausted through the exhaust portion of the manifold.

5. The valve assembly of claim 4 wherein the regulating means comprises means for varying the time the port opened during the compression stroke stays open such that the piston may travel a greater or lesser distance to push greater or lesser amounts of fluid from the cylinder until the compression port is closed such that the length of the effective compression stroke may be varied.

6. The valve assembly of claim 4 wherein the valve means comprises a poppet valve having a valve stem anchored in the block and head arrangement and a valve head extendible into the cylinder to open the poppet valve; and wherein the valve assembly further comprises a cam shaft fixed relative to the block and head arrangement and having a cam lobe thereon and a structure disposed between a portion of the cam and a portion of the valve stem such that the portion of the cam lobe engages the structure which in turn engages the portion of the valve stem to open the poppet valve, with the structure having means for increasing or decreasing an effective distance between the portion of the valve stem and the portion of the cam lobe such that the poppet valve extends to greater or lesser distances into the cylinder when open.

7. The valve assembly of claim 6 wherein the structure includes a tapered surface for increasing or decreasing the effective distance between the portion of the cam lobe and the portion of the valve stem.

8. A valve assembly for providing a variable effective compression stroke for a piston comprising, in combination:

a) a block and head arrangement having a cylinder formed by a cylinder sidewall and at least a first cylinder head, and a piston in the cylinder having intake, compression, power, and exhaust strokes, with the piston having a piston crown;

b) with the block and head arrangement comprising an intake port for permitting fluid flow to the cylinder during the intake stroke, an exhaust port for permitting fluid flow from the cylinder during the exhaust stroke, and at least a third port being openable during at least a portion of the compression stroke for permitting the piston to push fluid from the cylinder, with the third port being closeable whereupon pressure begins to build in the cylinder for an effective compression stroke;

c) valve means in the block and head arrangement for opening and closing the ports, the valve means being in close relationship with the piston crown at the top of the power stroke, with the valve means being at least partially exposed to fluid explosion causing the power stroke, the valve means further comprising means for regulating the amount of fluid pushed by the piston out of the third port during the compression stroke for varying the amount of pressure permitted to build in the cylinder for the effective compression stroke; and d) a fourth port in the block and head arrangement and a power output shagt trained to the piston, with the fourth port being communicable with the cylinder during the power stroke, with the valve means further comprising closure means for normally keeping the fourth port closed during the power stroke when during piston operation power from the piston relative to the power output shaft is desired and for optionally opening the fourth port during the power stroke when during piston operation no power from the piston relative to the power output shah is desired.

9. An internal combustion block and head arrangement for controlling air flow into an internal combustion cylinder and exhaust flow from the internal combustion cylinder, comprising:

a) a cylinder having two ends and a piston reciprocating therein, with the piston having at least one piston crown, with the piston driving a power output shaft and having intake, compression, power and exhaust strokes;

b) a cylinder head rigidly fixed to one of the ends of the cylinder and being substantially in the form of a plate to provide for a compact block and head arrangement, with the cylinder head being in close relationship with the piston crown during the top of the intake and power strokes to contain explosion of fluid, with the cylinder head further including a first port for intake of air during the intake stroke, a second port for exhausting air during at least a portion of the compression stroke for regulating effective compression stroke length, a third port for optionally permitting air to be drawn in during the power stroke, and a fourth port for expelling exhaust during the exhaust stroke;

c) closure means engaged with the cylinder head for regulating the size of the second and third ports;

d) a manifold rigidly fixed to the cylinder head and being substantially in the form of a plate to further contribute to the compact block and head arrangement, with the manifold including an inlet communicable with at least the first port of the cylinder head for permitting outside air to be introduced into the cylinder through the manifold and cylinder head, with the manifold further including an outlet communicating with at least the fourth port, with the second and third ports of the cylinder head communicable with one of the inlet and outlet of the manifold; and e) a valve sandwiched between the manifold and cylinder head and being substantially in the form of a plate to further contribute to the compact block and head arrangement, with the valve having a port opening and being rotatable such that the port opening is rotatable in sequence from the first port to the second port to the third port to the fourth port and back to the first port to permit one of the ports of the cylinder head to communicate with one of the inlet and outlet of the manifold.

10. The block and head arrangement of claim 9 wherein the closure means includes a first closure means for the second port and a second closure means for the third port, with each of the first and second closure means being substantially in the form of a plate to further contribute to the compact block and head arrangement.

11. A piston assembly for maximizing the effective distance the piston is driven during the power stroke to maximize the cooling of exhaust gases comprising, in combination:

a) a block and head arrangement having a cylinder with a cylinder sidewall and at least a first cylinder head, with the cylinder having an axis defining a piston stroke;

b) a piston with at least a first crown and being in the cylinder on the axis, with the piston having a piston sidewall in close relationship with the cylinder sidewall, with the piston reciprocating on the axis in the cylinder and including a power stroke and a compression stroke;

c) a power output shaft trained to the piston such that operation of the piston rotates the power output shaft;

d) with a fuel explosion in the block and head arrangement driving the piston through the power stroke, and with the block and head arrangement further comprising means for continuing to drive the piston past a point where energy from the fuel explosion alone is unable to drive the piston along the axis such that volume of exhaust gas in the cylinder is increased and thereby cooled prior to the piston being operated in an opposite direction for an exhaust stroke to expel exhaust gas from the block and head arrangement, with the means for continuing to drive the piston past the point where energy from the fuel explosion alone is unable to drive the piston comprises means for effectively lengthening the power stroke relative to the compression stroke, with the means for effectively lengthening the power stroke relative to the compression stroke includes a port in the block and head arrangement and means for regulating the port, with the means for regulating the port including means for opening the port for at least a portion of the compression stroke such that air is expelled by the piston out of the block and head arrangement during at least a portion of the compression stroke, and with the means for regulating the port including means for closing the port during at least a portion of the compression stroke such that pressure is permitted to build in the cylinder during at least a portion of the compression stroke such that the power stroke is effectively lengthened relative to the compression stroke; and e) with the block and head arrangement further comprising a manifold having an intake portion and an exhaust portion, with the port communicating with the exhaust portion of the manifold, with the block and head arrangement further comprising valve means for closing the port and the exhaust portion when the intake portion is open and closing the intake portion when the port and exhaust portion are open such that air utilized for varying the amount of pressure permitted to build in the cylinder for the effective compression stroke is drawn in through the intake portion of the manifold and exhausted through the exhaust portion of the manifold.

12. A valve assembly for providing a variable effective compression stroke for a piston comprising, in combination:

a) a block and head arrangement having a cylinder formed by a cylinder sidewall and at least a first cylinder head, and a piston in the cylinder having intake, compression, power, and exhaust strokes, with the piston having a piston crown;

b) with the block and head arrangement comprising an intake port for permitting fluid flow to the cylinder during the intake stroke, an exhaust port for permitting fluid flow from the cylinder during the exhaust stroke, and at least a third port being openable during at least a portion of the compression stroke for permitting the piston to push fluid from the cylinder, with the third port being closeable whereupon pressure begins to build in the cylinder for an effective compression stroke; and c) valve means in the block and head arrangement for opening and closing the ports, the valve means being in close relationship with the piston crown at the top of the power stroke, with the valve means being at least partially exposed to fluid explosion causing the power stroke, the valve means further comprising means for regulating the amount of fluid pushed by the piston out of the third port during the compression stroke for varying the amount of pressure permitted to build in the cylinder for the effective compression stroke, with the valve means comprising a rotary valve structure for opening and closing each of the ports.

* * * * *